US007645929B2

(12) United States Patent
Chang et al.

(10) Patent No.: US 7,645,929 B2
(45) Date of Patent: Jan. 12, 2010

(54) COMPUTATIONAL MUSIC-TEMPO ESTIMATION

(75) Inventors: Yu-Yao Chang, Stanford, CA (US); Ramin Samadani, Menlo Park, CA (US); Tong Zhang, San Jose, CA (US); Simon Widdowson, Dublin, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/519,545

(22) Filed: Sep. 11, 2006

(65) Prior Publication Data

US 2008/0060505 A1 Mar. 13, 2008

(51) Int. Cl.
*G04F 10/06* (2006.01)

(52) U.S. Cl. ..... 84/612; 84/636; 84/652; 84/714; 700/94

(58) Field of Classification Search ..... 84/612, 84/636, 652, 669, 714; 700/94
See application file for complete search history.

(56) References Cited

U.S. PATENT DOCUMENTS 5,616,876 A * 4/1997 Cluts ..... 84/609
6,225,546 B1 * 5/2001 Kraft et al. ..... 84/609
6,316,712 B1 * 11/2001 Laroche ..... 84/636
6,323,412 B1 * 11/2001 Loo ..... 84/636
6,518,492 B2 * 2/2003 Herberger et al. ..... 84/636
6,545,209 B1 * 4/2003 Flannery et al. ..... 84/609
6,657,117 B2 * 12/2003 Weare et al. ..... 84/668
6,787,689 B1 * 9/2004 Chen ..... 84/600
6,812,394 B2 * 11/2004 Weissflog ..... 84/667

(Continued)

OTHER PUBLICATIONS

Dixon, S. "Beat Induction and Rhythm Recognition" Proc. of the Australian Joint Conf on Artificial Intelligence, Jan 1, 1997, pp. 1-10.

(Continued)

*Primary Examiner*—David S. Warren

(57) ABSTRACT

Various method and system embodiments of the present invention are directed to computational estimation of a tempo for a digitally encoded musical selection. In certain embodiments of the present invention, described below, a short portion of a musical selection is analyzed to determine the tempo of the musical selection. The digitally encoded musical selection sample is computationally transformed to produce a power spectrum corresponding to the sample, in turn transformed to produce a two-dimensional strength-of-onset matrix. The two-dimensional strength-of-onset matrix is then transformed into a set of strength-of-onset/time functions for each of a corresponding set of frequency bands. The strength-of-onset/time functions are then analyzed to find a most reliable onset interval that is transformed into an estimated tempo returned by the analysis.

20 Claims, 20 Drawing Sheets

U.S. PATENT DOCUMENTS

| | | | | |
|---|---|---|---|---|
| 6,856,923 | B2 * | 2/2005 | Jung | 702/71 |
| 7,022,907 | B2 * | 4/2006 | Lu et al. | 84/611 |
| 7,091,409 | B2 * | 8/2006 | Li et al. | 84/634 |
| 7,115,808 | B2 * | 10/2006 | Lu et al. | 84/611 |
| 7,132,595 | B2 * | 11/2006 | Lu et al. | 84/612 |
| 7,148,415 | B2 * | 12/2006 | Lengeling et al. | 84/611 |
| 7,183,479 | B2 * | 2/2007 | Lu et al. | 84/612 |
| 7,240,207 | B2 * | 7/2007 | Weare | 713/176 |
| 7,250,566 | B2 * | 7/2007 | Lengeling et al. | 84/611 |
| 2002/0037083 | A1 * | 3/2002 | Weare et al. | 381/58 |
| 2002/0039887 | A1 * | 4/2002 | Delabbaye et al. | 455/42 |
| 2002/0087565 | A1 * | 7/2002 | Hoekman et al. | 707/100 |
| 2002/0134222 | A1 * | 9/2002 | Tamura | 84/622 |
| 2002/0148347 | A1 * | 10/2002 | Herberger et al. | 84/636 |
| 2002/0172372 | A1 * | 11/2002 | Tagawa et al. | 381/56 |
| 2002/0181711 | A1 * | 12/2002 | Logan et al. | 381/1 |
| 2003/0014419 | A1 * | 1/2003 | Clapper | 707/101 |
| 2003/0037036 | A1 * | 2/2003 | Weare | 707/1 |
| 2003/0040904 | A1 * | 2/2003 | Whitman et al. | 704/212 |
| 2003/0045953 | A1 * | 3/2003 | Weare | 700/94 |
| 2003/0045954 | A1 * | 3/2003 | Weare et al. | 700/94 |
| 2003/0048946 | A1 * | 3/2003 | Foote et al. | 382/173 |
| 2003/0055325 | A1 * | 3/2003 | Weber et al. | 600/323 |
| 2003/0106413 | A1 * | 6/2003 | Samadani et al. | 84/603 |
| 2003/0130848 | A1 * | 7/2003 | Sheikhzadeh-Nadjar et al. | 704/260 |
| 2003/0135377 | A1 * | 7/2003 | Kurianski et al. | 704/500 |
| 2003/0205124 | A1 * | 11/2003 | Foote et al. | 84/608 |
| 2004/0044487 | A1 * | 3/2004 | Jung | 702/75 |
| 2004/0060426 | A1 * | 4/2004 | Weare et al. | 84/668 |
| 2004/0069123 | A1 * | 4/2004 | Becker et al. | 84/612 |
| 2004/0107821 | A1 * | 6/2004 | Alcalde et al. | 84/608 |
| 2004/0181401 | A1 * | 9/2004 | Pachet et al. | 704/223 |
| 2004/0231498 | A1 * | 11/2004 | Li et al. | 84/634 |
| 2005/0092165 | A1 * | 5/2005 | Weare et al. | 84/668 |
| 2005/0097075 | A1 * | 5/2005 | Hoekman et al. | 707/1 |
| 2005/0120868 | A1 * | 6/2005 | Hinman et al. | 84/615 |
| 2005/0131285 | A1 * | 6/2005 | Weber et al. | 600/323 |
| 2005/0211071 | A1 * | 9/2005 | Lu et al. | 84/611 |
| 2005/0211072 | A1 * | 9/2005 | Lu et al. | 84/612 |
| 2005/0217461 | A1 * | 10/2005 | Wang | 84/608 |
| 2006/0048634 | A1 * | 3/2006 | Lu et al. | 84/612 |
| 2006/0054007 | A1 * | 3/2006 | Lu et al. | 84/611 |
| 2006/0060067 | A1 * | 3/2006 | Lu et al. | 84/612 |
| 2006/0185501 | A1 * | 8/2006 | Shiraishi et al. | 84/612 |
| 2006/0288849 | A1 * | 12/2006 | Peeters | 84/616 |
| 2007/0022867 | A1 * | 2/2007 | Yamashita | 84/612 |
| 2007/0055500 | A1 * | 3/2007 | Bilobrov | 704/217 |
| 2007/0089592 | A1 * | 4/2007 | Wilson et al. | 84/612 |
| 2007/0094251 | A1 * | 4/2007 | Lu et al. | 707/5 |
| 2007/0131096 | A1 * | 6/2007 | Lu et al. | 84/611 |
| 2007/0180980 | A1 * | 8/2007 | Kim | 84/612 |

OTHER PUBLICATIONS

Klapuri, A "Musical Meter Estimation and Music Transcription", Proc. Cambridge Music Processing colloquim, Mar. 28, 2003, pp. 1-6.

Collins, N Beat Induction and Rhythm Analysis for Live Audio Processing: 1st Year PhD Report, Jun. 18, 2004, pp. 1-26.

Goto, M et al "A Real-time Beat Tracking System for Audio Signals" ICMC, Intl Computer Music Conf., Sept 1, 1995, pp. 171-174.

Seppanen, J "Tatum Grid analysis of Musical Signals", Ajpplications of Signal Processing to Audio and Acoustics, 2001 IEEE Workshop, Oct. 21-24, 2001, pp. 131-134.

* cited by examiner interval = $4\Delta t$
phase = $\Delta t$ interval = $4\Delta t$
phase = $2\Delta t$ interval = $4\Delta t$
phase = $3\Delta t$

COMPUTATIONAL MUSIC-TEMPO ESTIMATION

TECHNICAL FIELD

The present invention is related to signal processing and signal characterization and, in particular, to a method and system for estimating a tempo for an audio signal corresponding to a short portion of a musical composition.

BACKGROUND OF THE INVENTION

As the processing power, data capacity, and functionality of personal computers and computer systems have increased, personal computers interconnected with other personal computers and higher-end computer systems have become a major medium for transmission of a variety of different types of information and entertainment, including music. Users of personal computers can download a vast number of different, digitally encoded musical selections from the Internet, store digitally encoded musical selections on a mass-storage device within, or associated with, the personal computers, and can retrieve and play the musical selections through audio-playback software, firmware, and hardware components. Personal computer users can receive live, streaming audio broadcasts from thousands of different radio stations and other audio-broadcasting entities via the Internet.

As users have begun to accumulate large numbers of musical selections, and have begun to experience a need to manage and search their accumulated musical selections, software and computer vendors have begun to provide various software tools to allow users to organize, manage, and browse stored musical selections. For both musical-selection storage and browsing operations, it is frequently necessary to characterize musical selections, either by relying on text-encoded attributes, associated with digitally encoded musical selections by users or musical-selection providers, including titles and thumbnail descriptions, or, often more desirably, by analyzing the digitally encoded musical selection in order to determine various characteristics of the musical selection. As one example, users may attempt to characterize musical selections by a number of music-parameter values in order to collocate similar music within particular directories or subdirectory trees and may input music-parameter values into a musical-selection browser in order to narrow and focus a search for particular musical selections. More sophisticated musical-selection browsing applications may employ musical-selection-characterizing techniques to provide sophisticated, automated searching and browsing of both locally stored and remotely stored musical selections.

The tempo of a played or broadcast musical selection is one commonly encountered musical parameter. Listeners can often easily and intuitively assign a tempo, or primary perceived speed, to a musical selection, although assignment of tempo is generally not unambiguous, and a given listener may assign different tempos to the same musical selection presented in different musical contexts. However, the primary speeds, or tempos, in beats per minute, of a given musical selection assigned by a large number of listeners generally fall into one or a few discrete, narrow bands. Moreover, perceived tempos generally correspond to signal features of the audio signal that represents a musical selection. Because tempo is a commonly recognized and fundamental music parameter, computer users, software vendors, music providers, and music broadcasters have all recognized the need for effective computational methods for determining a tempo value for a given musical selection that can be used as a parameter for organizing, storing, retrieving, and searching for digitally encoded musical selections.

SUMMARY OF THE INVENTION

Various method and system embodiments of the present invention are directed to computational estimation of a tempo for a digitally encoded musical selection. In certain embodiments of the present invention, described below, a short portion of a musical selection is analyzed to determine the tempo of the musical selection. The digitally encoded musical selection sample is computationally transformed to produce a power spectrum corresponding to the sample, in turn transformed to produce a two-dimensional strength-of-onset matrix. The two-dimensional strength-of-onset matrix is then transformed into a set of strength-of-onset/time functions for each of a corresponding set of frequency bands. The strength-of-onset/time functions are then analyzed to find a most reliable onset interval that is transformed into an estimated tempo returned by the analysis.

DETAILED DESCRIPTION OF THE INVENTION

Various method and system embodiments of the present invention are directed to computational determination of an estimated tempo for a digitally encoded musical selection. As discussed below, in detail, a short portion of the musical selection is transformed to produce a number of strength-of-onset/time functions that are analyzed to determine an estimated tempo. In the following discussion, audio signals are first discussed, in overview, followed by a discussion of the various transformations used in method embodiments of the present invention to produce strength-of-onset/time functions for a set of frequency bands. Analysis of the strength-of-onset/time functions is then described using both graphical illustrations and flow-control diagrams.

Figure 1A:
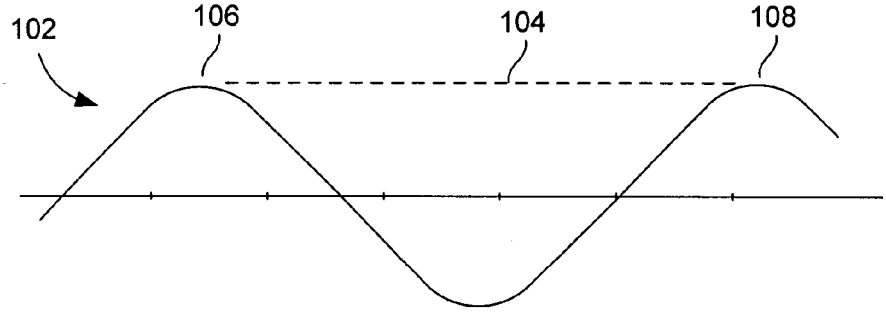
FIGS. 1A-G illustrate a combination of a number of component audio signals, or component waveforms, to produce an audio waveform.
Figure 1B:
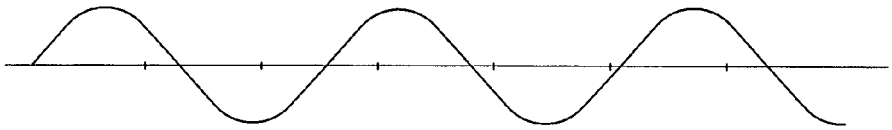
Figure 1C:
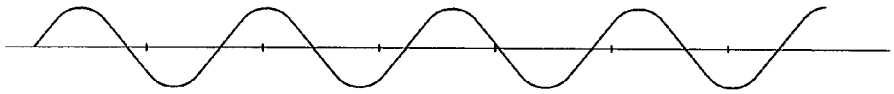
Figure 1D:
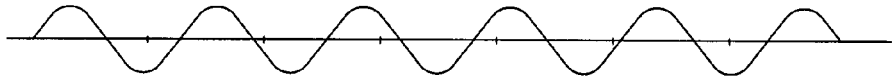
Figure 1E:
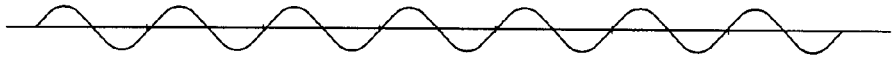
Figure 1F:
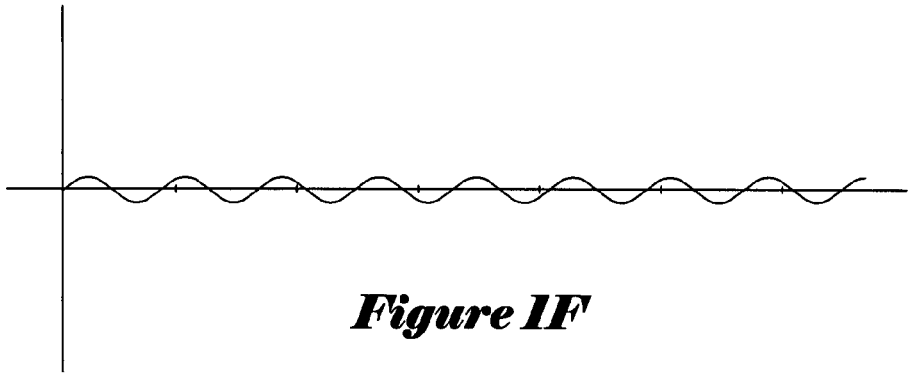
Figure 1G:
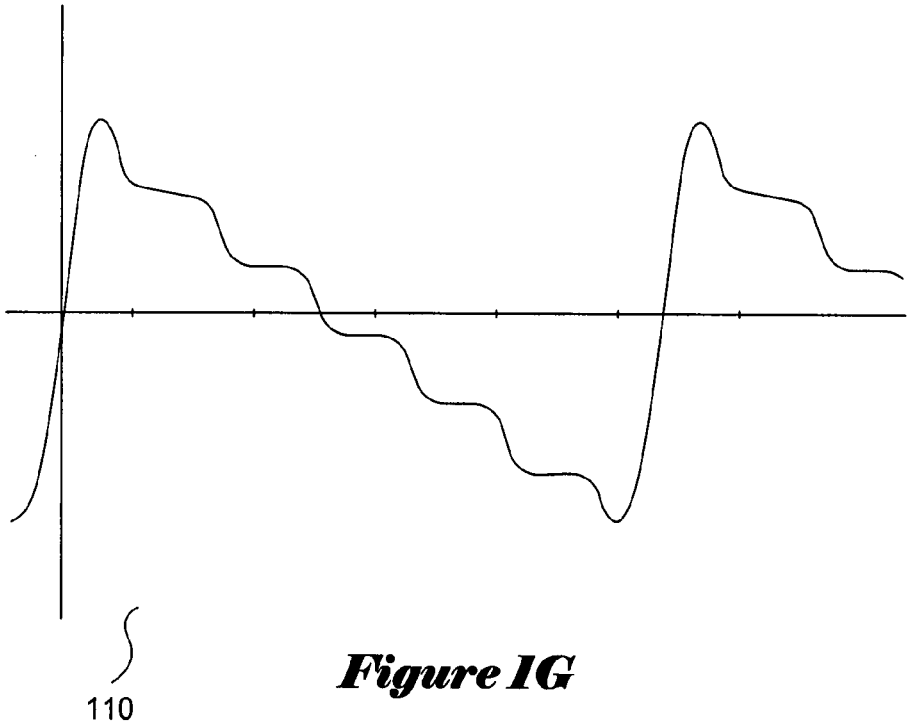

FIGS. 1A-G illustrate a combination of a number of component audio signals, or component waveforms, to produce an audio waveform. Although the waveform composition illustrated in FIGS. 1A-G is a special case of general waveform composition, the example illustrates that a generally complex audio waveform may be composed of a number of simple, single-frequency waveform components. FIG. 1A shows a portion of the first of six simple component waveforms. An audio signal is essentially an oscillating air-pressure disturbance that propagates through space. When viewed at a particular point in space over time, the air pressure regularly oscillates about a median air pressure. The waveform 102 in FIG. 1A, a sinusoidal wave with pressure plotted along the vertical axis and time plotted along the horizontal axis, graphically displays the air pressure at a particular point in space as a function of time. The intensity of a sound wave is proportional to the square of the pressure amplitude of the sound wave. A similar waveform is also obtained by measuring pressures at various points in space along a straight ray emanating from a sound source at a particular instance in time. Returning to the waveform presentation of the air pressure at a particular point in space for a period of time, the distance between any two peaks in the waveform, such as the distance 104 between peaks 106 and 108, is the time between successive oscillations in the air-pressure disturbance. The reciprocal of that time is the frequency of the waveform. Considering the component waveform shown in FIG. 1A to have a fundamental frequency f, the waveforms shown in FIGS. 1B-F represent various higher-order harmonics of the fundamental frequency. Harmonic frequencies are integer multiples of the fundamental frequency. Thus, for example, the frequency of the component waveform shown in FIG. 1B, 2f, is twice that of the fundamental frequency shown in FIG. 1A, since two complete cycles occur in the component waveform shown in FIG. 1B in the same time as one cycle occurs in the component waveform having fundamental frequency f. The component waveforms of FIGS. 1C-F have frequencies 3f, 4f, 5f, and 6f, respectively. Summation of the six waveforms shown in FIGS. 1A-F produces the audio waveform 110 shown in FIG. 1G. The audio waveform might represent a single note played on a stringed or wind instrument. The audio waveform has a more complex shape than the sinusoidal, single-frequency, component waveforms shown in FIGS. 1A-F. However, the audio waveform can be seen to repeat at the fundamental frequency, f, and exhibits regular patterns at higher frequencies.

Figure 2:
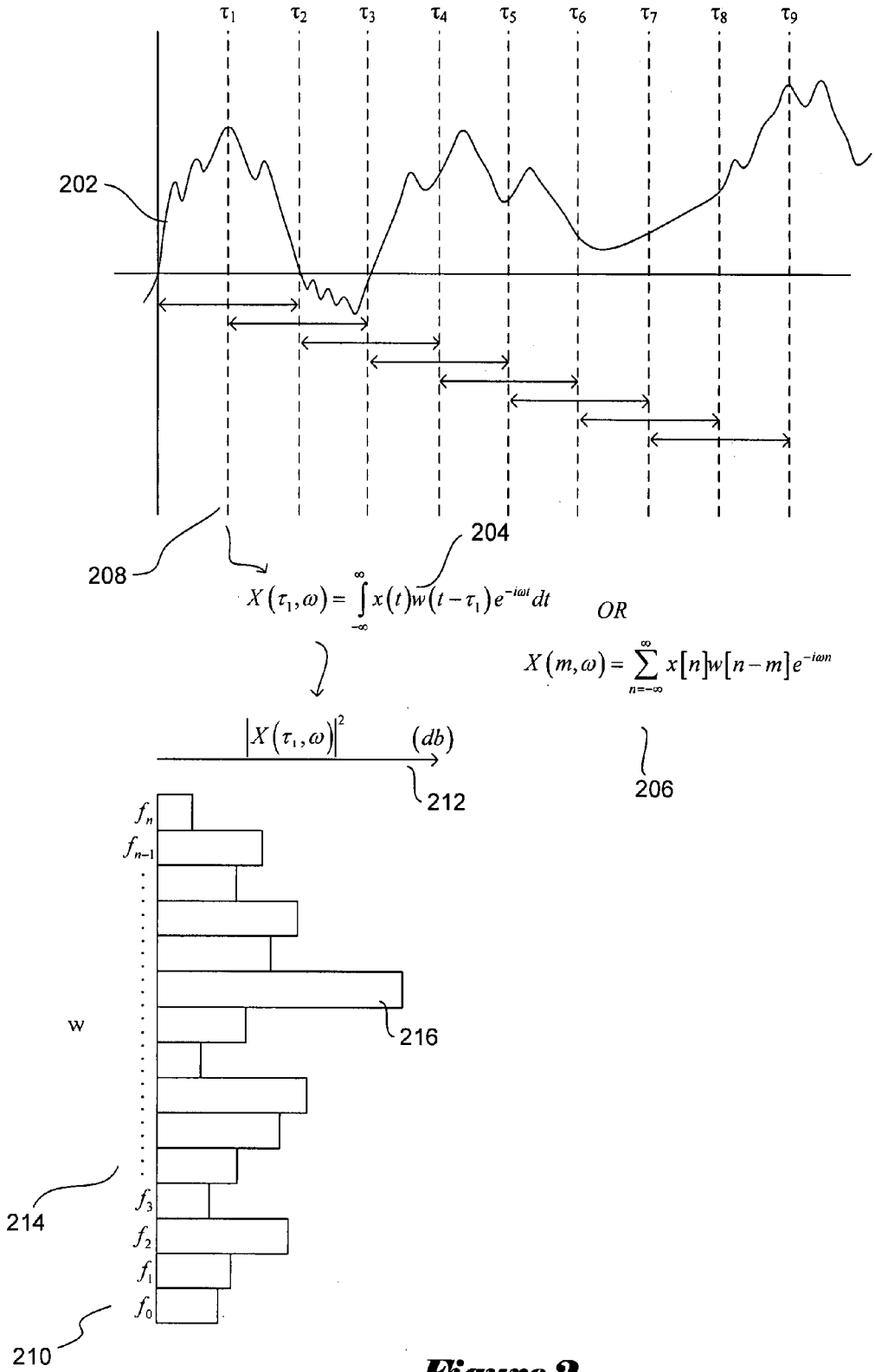
FIG. 2 illustrates a mathematical technique to decompose complex waveforms into component-waveform frequencies.

Waveforms corresponding to a complex musical selection, such as a song played by a band or orchestra, may be extremely complex and composed of many hundreds of different component waveforms. As can be seen in the example of FIGS. 1A-G, it would be exceedingly difficult to decompose waveform 110, shown in FIG. 1G, into the component waveforms shown in FIGS. 1A-F by inspection or intuition. For the exceedingly complex waveforms that represent performed musical compositions, decomposition by inspection or intuition would be practically impossible. Mathematical techniques have been developed to decompose complex waveforms into component-waveform frequencies. FIG. 2 illustrates a mathematical technique to decompose complex waveforms into component-waveform frequencies. In FIG. 2, amplitude of a complex waveform 202 is shown plotted with respect to time. This waveform can be mathematically transformed, using a short-time Fourier transform method, to produce a plot of the magnitudes of component waveforms at each frequency within a range of frequencies for a given, short period of time. FIG. 2 shows both a continuous short-term Fourier transform 204:

$$X(\tau_1, \omega) = \int_{-\infty}^{\infty} x(t)w(t-\tau_1)e^{-i\omega\mu}\,dt$$

where $\tau_1$ is a point in time, x(t) is a function that describes a waveform, $w(t-\tau_1)$ is a time-window function, ω is a selected frequency, and $X(\tau_1,\omega)$ is the magnitude, pressure, or energy of the component waveform of waveform x(t) with frequency ω at time $\tau_1$.

and a discrete 206 version of the short-term Fourier transform:

$$X(m, \omega) = \sum_{n=-\infty}^{\infty} x[n]w[n-m]e^{-i\omega n}$$

where m is a selected time interval, x[n] is a discrete function that describes a waveform, w[n−m] is a time-window function, ω is a selected frequency, and X(m,ω) is the magnitude, pressure, or energy of the component waveform of waveform x[n] with frequency ω over time interval m.

The short-term Fourier transform is applied to a window in time centered around a particular point in time, or sample time, with respect to the time-domain waveform (202 in FIG. 2). For example, the continuous 204 and discrete 206 Fourier transforms shown in FIG. 2 are applied to a small time window centered at time $\tau_1$ (or time interval m, in the discrete case) 208 to produce a two-dimensional frequency-domain plot 210 in which the intensity, in decibels (db) is plotted along the horizontal axis 212 and frequency is plotted along the vertical axis 214. The frequency-domain plot 210 indicates the magnitude of component waves with frequencies over a range of frequencies $f_0$ to $f_{n-1}$ that contribute to the waveform 202. The continuous short-time Fourier transform 204 is appropriately used for analog signal analysis, while the discrete short-time Fourier transform 206 is appropriately used for digitally encoded waveforms. In one embodiment of the present invention, a 4096-point fast Fourier transform with a Hamming window and 3584-point overlapping is used, with an input sampling rate of 44100 Hz, to produce the spectrogram.

Figure 3:
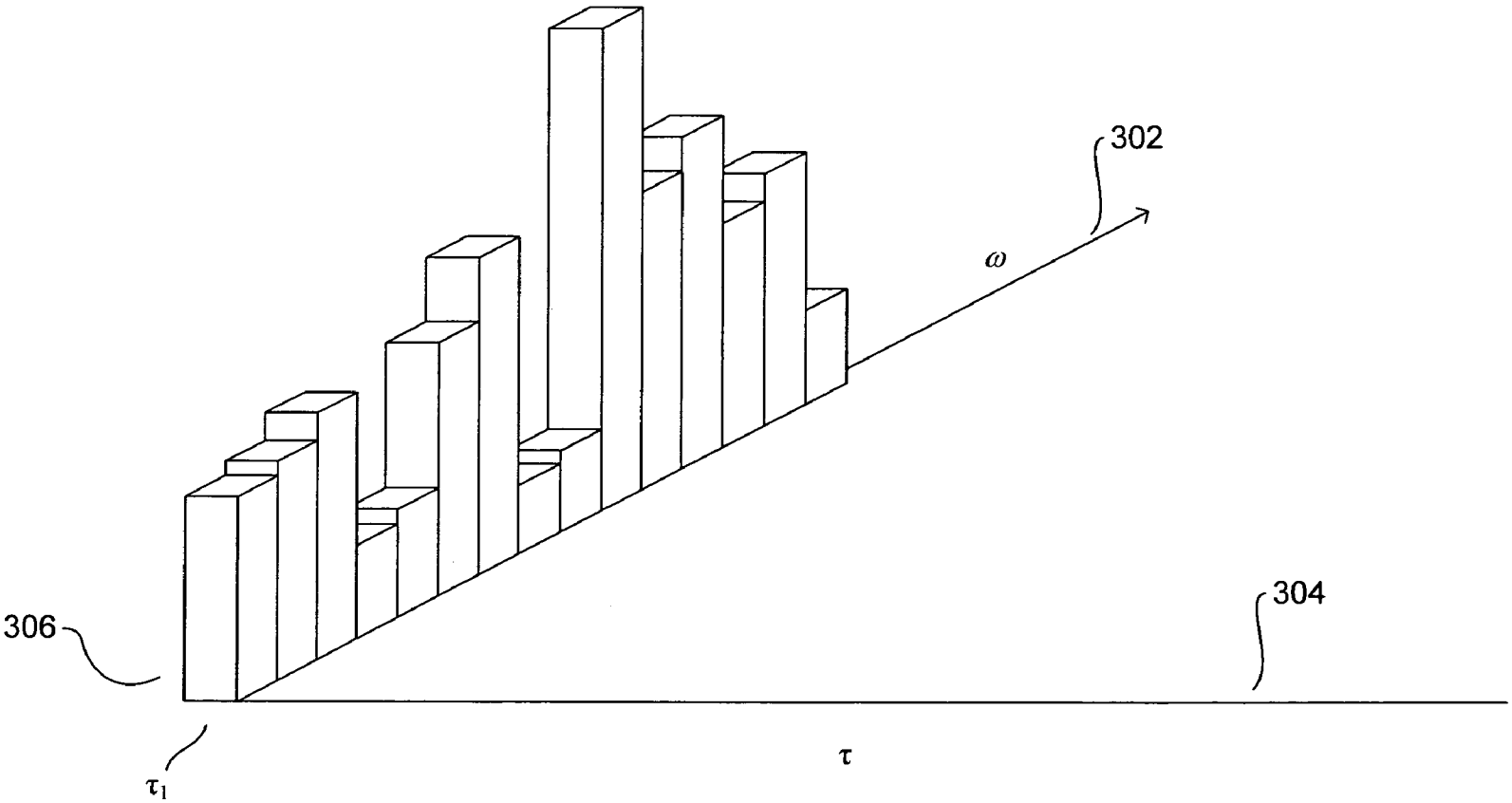
FIG. 3 shows a first frequency-domain plot entered into a three-dimensional plot of magnitude with respect to frequency and time.
Figure 4:
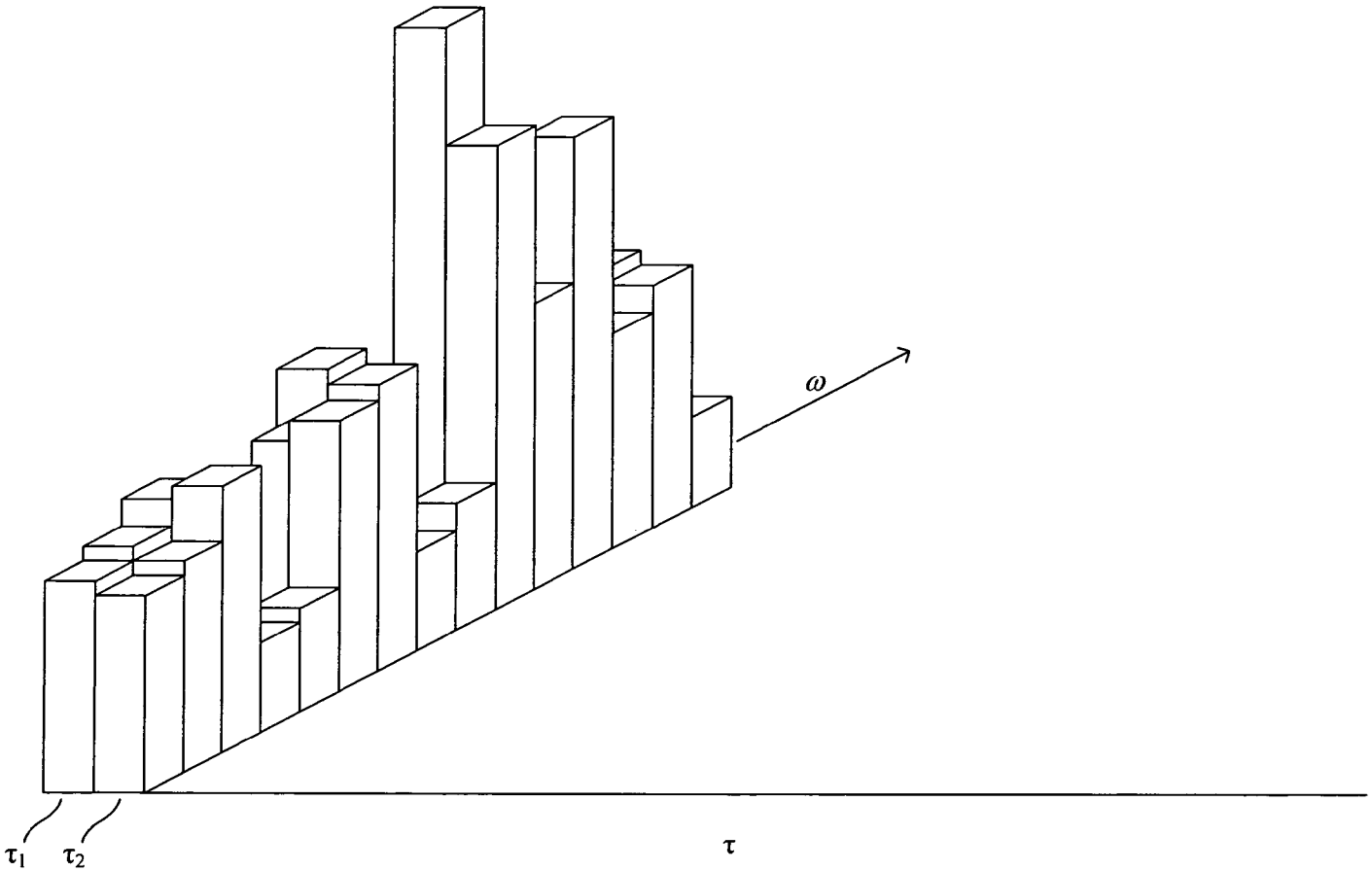
FIG. 4 shows a three-dimensional frequency, time, and magnitude plot with two columns of plotted data coincident with the time axis at times $\tau_1$ and $\tau_2$.

The frequency-domain plot corresponding to the time-domain time $\tau_1$ can be entered into a three-dimensional plot of magnitude with respect to frequency and time. FIG. 3 shows a first frequency-domain plot entered into a three-dimensional plot of magnitude with respect to frequency and time. The two-dimensional frequency-domain plot 214 shown in FIG. 2 is rotated by 90° with respect to the vertical axis of the plot, out of the plane of the paper, and inserted parallel to the frequency axis 302 at a position along the time axis 304 corresponding to time $\tau_1$. In similar fashion, a next frequency-domain two-dimensional plot can be obtained by applying the short-time Fourier transform to the waveform (202 in FIG. 2) at time $\tau_2$, and that two-dimensional plot can be added to the three-dimensional plot of FIG. 3 to produce a three-dimensional plot with two columns. FIG. 4 shows a three-dimensional frequency, time, and magnitude plot with two columns of plotted data positioned at sample times $\tau_1$ and $\tau_2$. Continuing in this fashion, an entire three-dimensional plot of the waveform can be generated by successive applications of the short-time Fourier transform at each of regularly spaced time intervals to the audio waveform in the time domain.

Figure 5:
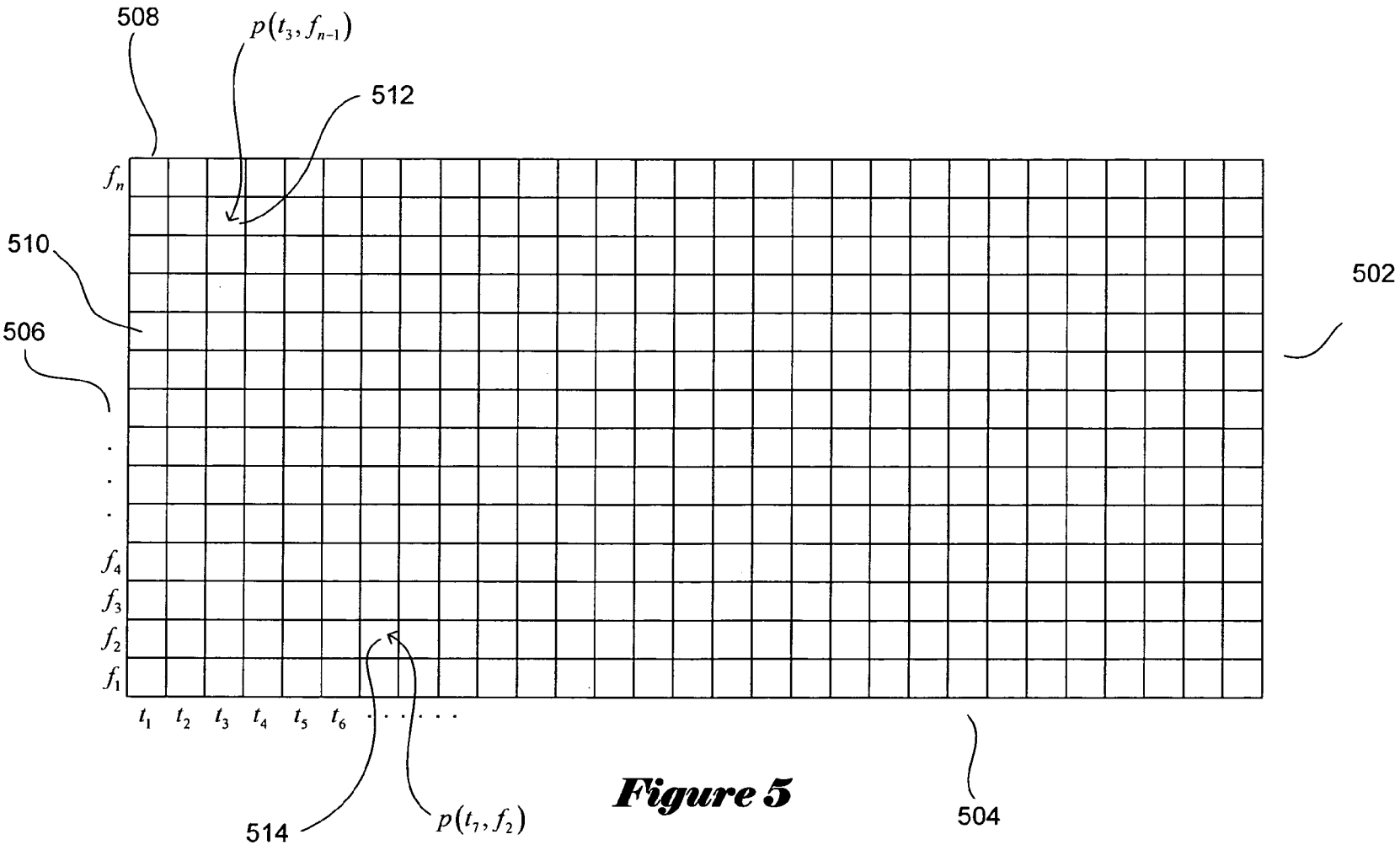
FIG. 5 illustrates a spectrogram produced by the method described with respect to FIGS. 2-4.

FIG. 5 illustrates a spectrogram produced by the method described with respect to FIGS. 2-4. FIG. 5 is plotted two-dimensionally, rather than in three-dimensional perspective, as FIGS. 3 and 4. The spectrogram 502 has a horizontal time axis 504 and a vertical frequency axis 506. The spectrogram contains a column of intensity values for each sample time. For example, column 508 corresponds to the two-dimensional frequency-domain plot (214 in FIG. 2) generated by the short-time Fourier transform applied to the waveform (202 in FIG. 2) at time $\tau_1$ (208 in FIG. 2). Each cell in the spectrogram contains an intensity value corresponding to the magnitude computed for a particular frequency at a particular time. For example, cell 510 in FIG. 5 contains an intensity value $p(t_1,f_{10})$ corresponding to the length of row 216 in FIG. 2 computed from the complex audio waveform (202 in FIG. 2) at time $\tau_1$. FIG. 5 shows power-notation $p(t_x, f_y)$ annotations for two additional cells 512 and 514 in the spectrogram 502. Spectrograms may be encoded numerically in two-dimensional arrays in computer memories and are often displayed on display devices as two-dimensional matrices or arrays with displayed color coding of the cells corresponding to the power.

Figure 6A:
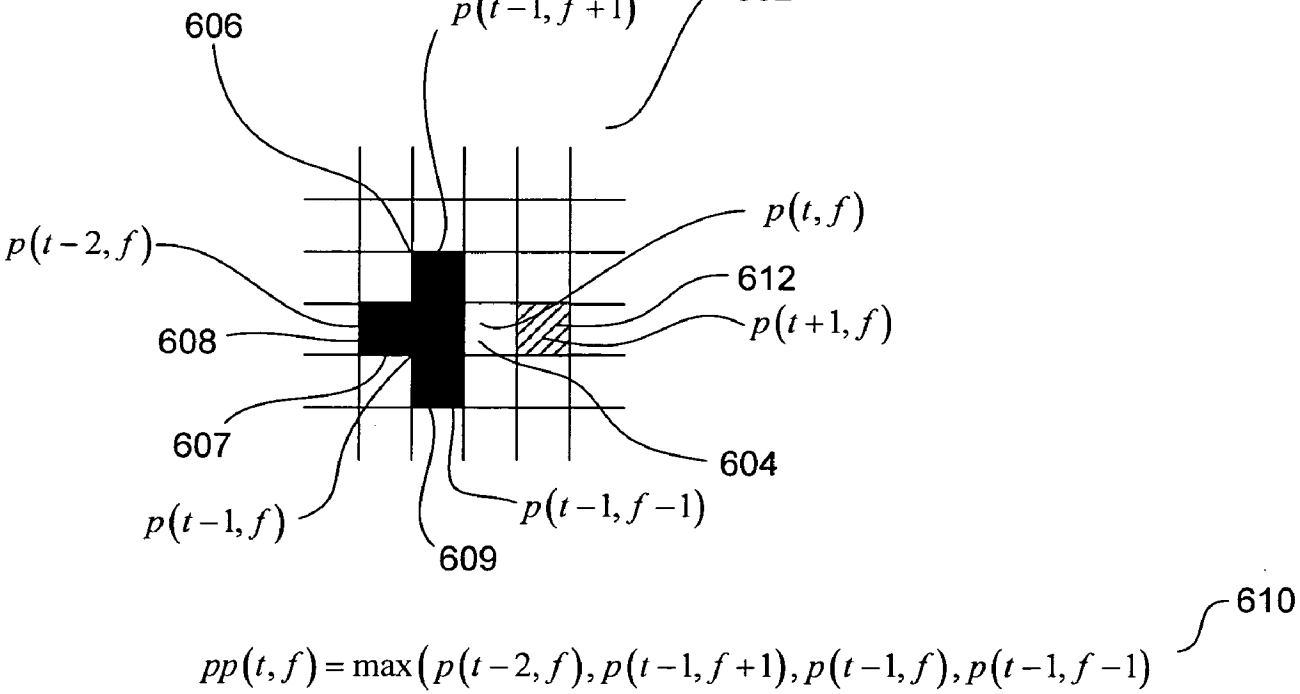
FIGS. 6A-C illustrate the first of the two transformations of a spectrogram used in method embodiments of the present invention.
Figure 6B:
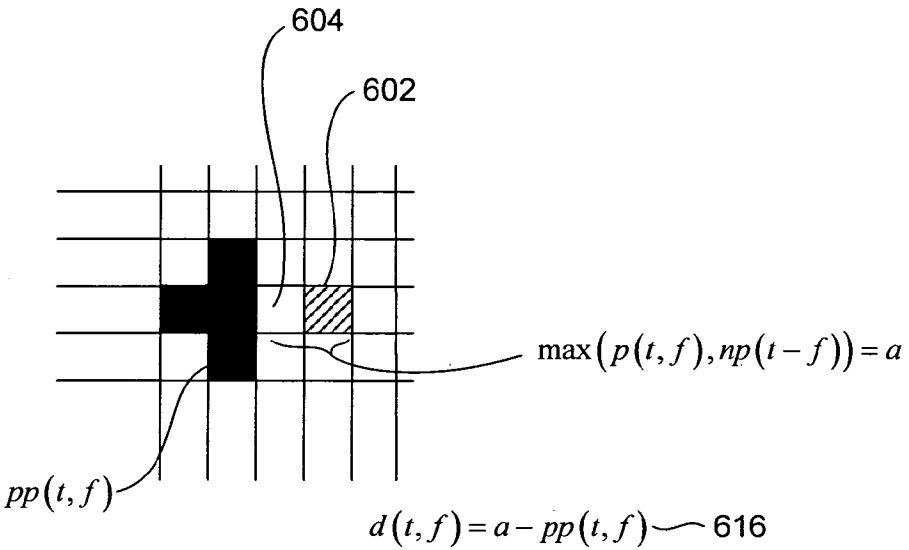
Figure 6C:
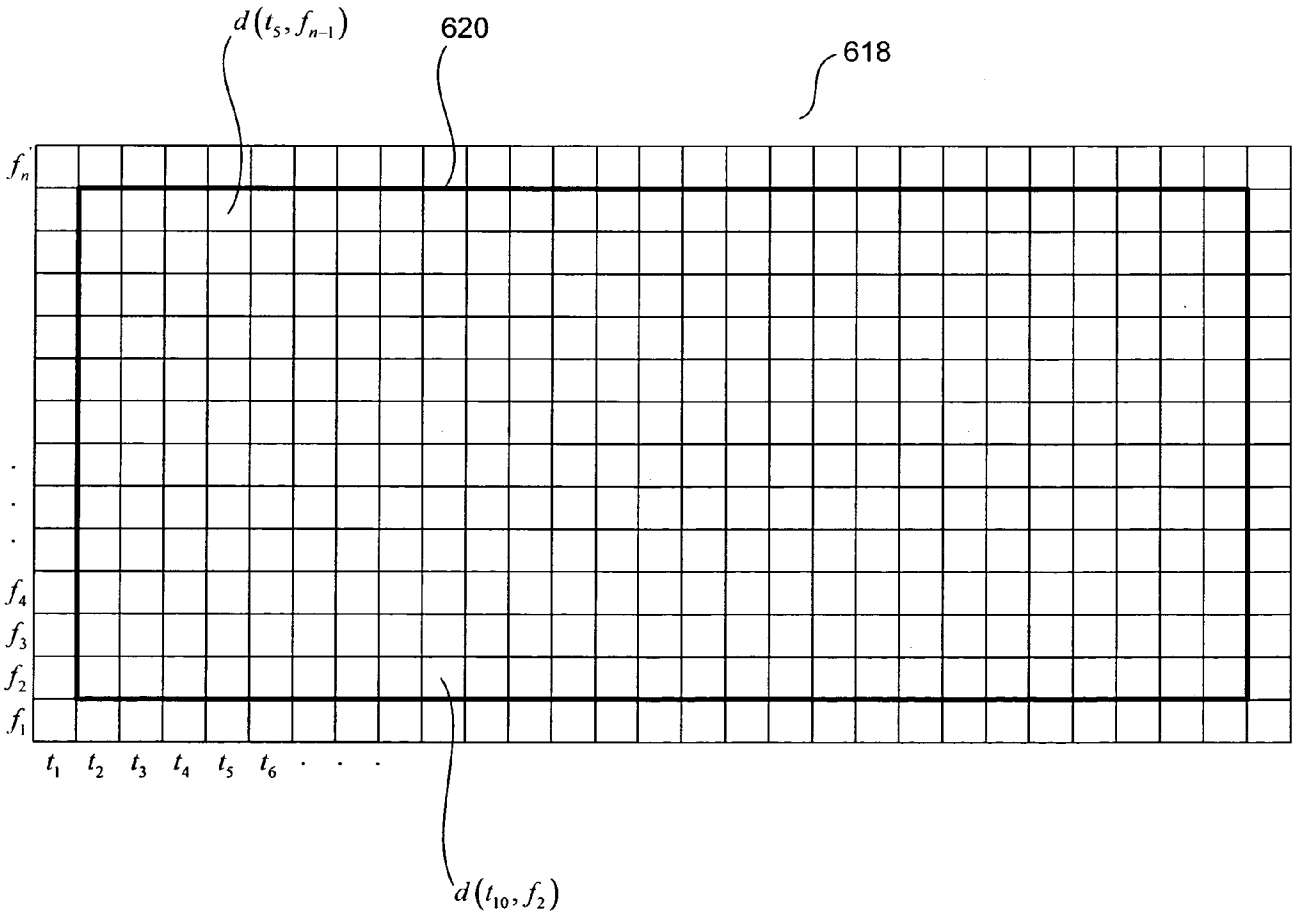

While the spectrogram is a convenient tool for analysis of the dynamic contributions of component waveforms of different frequencies to an audio signal, the spectrogram does not emphasize the rates of change in intensity with respect to time. Various embodiments of the present invention employ two additional transformations, beginning with the spectrogram, to produce a set of strength-of-onset/time functions for a corresponding set of frequency bands from which a tempo can be estimated. FIGS. 6A-C illustrate the first of the two transformations of a spectrogram used in method embodiments of the present invention. In FIGS. 6A-B, a small portion 602 of a spectrogram is shown. At a given point, or cell, within the spectrogram 604, p(t,f), a strength of onset d(t,f) for the time and frequency represented by the given point, or cell, in the spectrogram 604 can be computed. A previous intensity pp(t,f) is computed as the maximum of four points, or cells, 606-609 preceding the given point in time, as described by the first expression 610 in FIG. 6A:

$$pp(t,f)=\max(p(t-2,f),p(t-1,f+1),p(t-1,f),p(t-1,f-1))$$

A next intensity np(t,f) is computed from a single cell 612 that follows the given cell 604 in time, as shown in FIG. 6A by expression 614:

$$np(t,f)=p(t+1,f)$$

Then, as shown in FIG. 6B, the term a is computed as the maximum power value of the cell corresponding to the next power 612 and the given cell 604:

$$a=\max(p(t,f),np(t,f))$$

Finally, the strength of onset d(t,f) is computed at the given point as the difference between a and pp(t,f), as shown by expression 616 in FIG. 6B:

$$d(t,f)=a-pp(t,f)$$

A strength of onset value can be computed for each interior point of a spectrogram to produce a two-dimensional strength-of-onset matrix 618, as shown in FIG. 6C. Each internal point, or internal cell, within the bolded rectangle 620 that defines the borders of the two-dimensional strength-of-onset matrix is associated with a strength-of-onset value d(t, f). The bolded rectangle is intended to show that the two-dimensional strength-of-onset matrix, when overlaid above the spectrogram from which it is calculated, omits certain edge cells of the spectrogram for which d(t,f) cannot be computed.

Figure 7A:
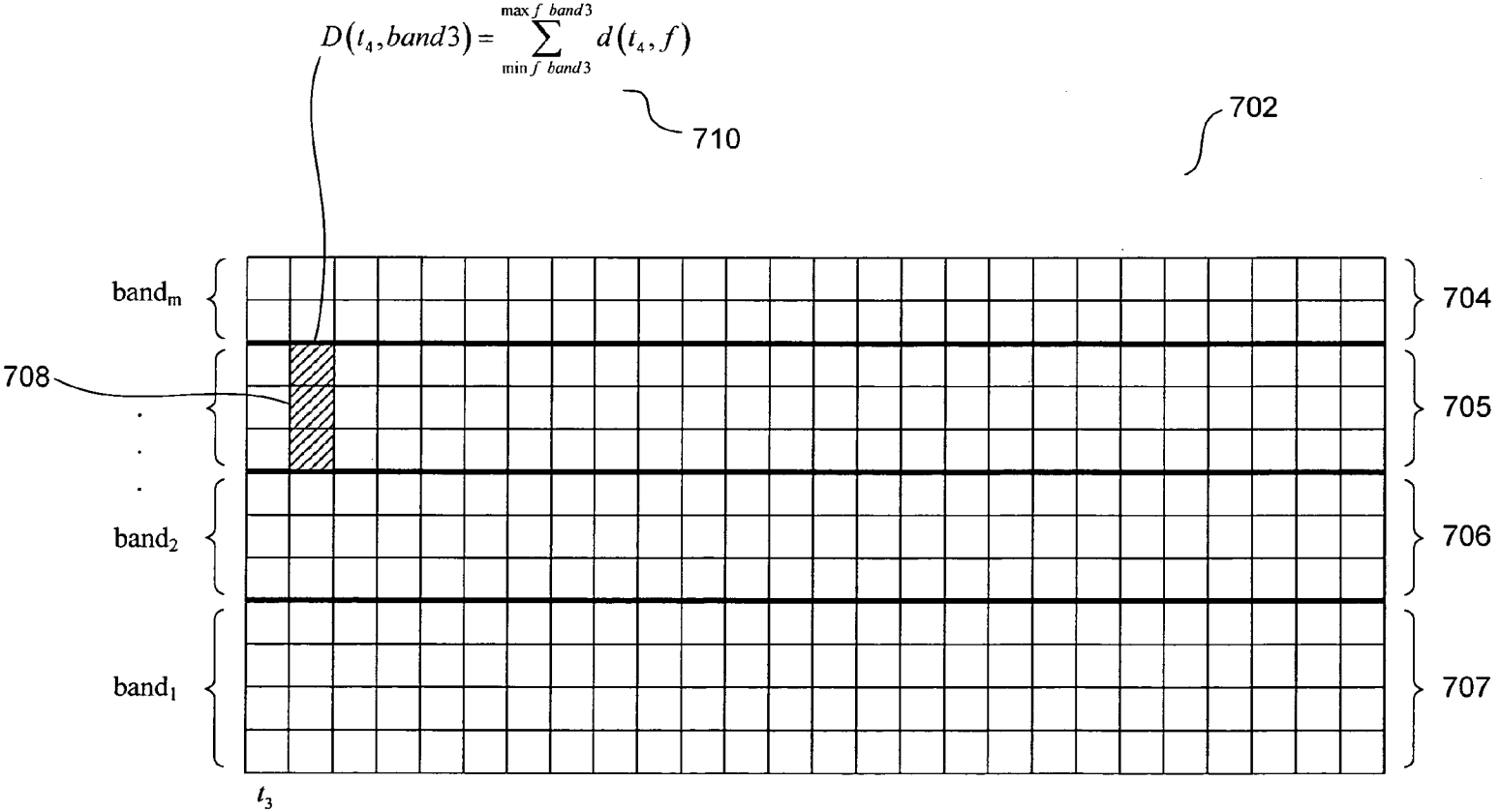
FIGS. 7A-B illustrate computation of strength-of-onset/time functions for a set of frequency bands.
Figure 7B:
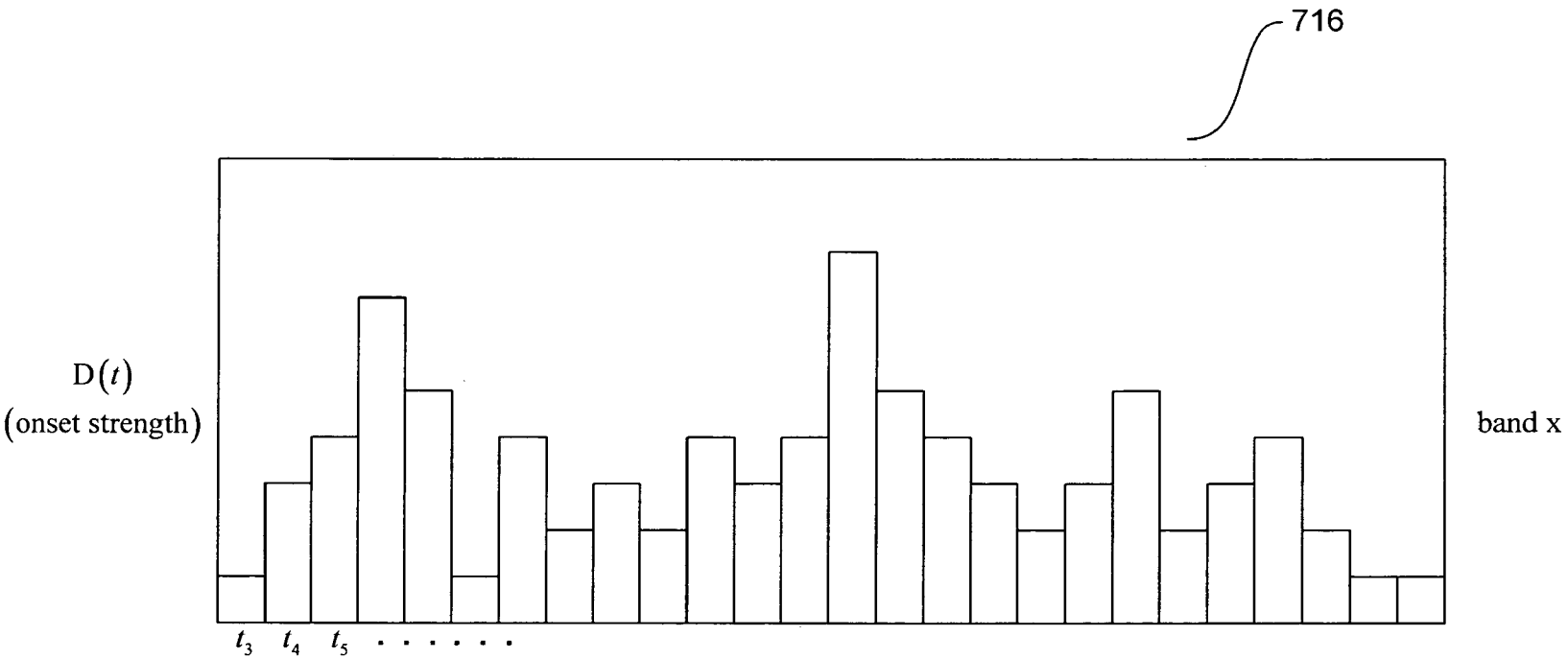

While the two-dimensional strength-of-onset plot includes local intensity-change values, such plots generally contain sufficient noise and local variation that it is difficult to discern a tempo. Therefore, in a second transformation, strength-of-onset/time functions for discrete frequency bands are computed. FIGS. 7A-B illustrate computation of strength-of-onset/time functions for a set of frequency bands. As shown in FIG. 7A, the two-dimensional strength-of-onset matrix 702 can be partitioned into a number of horizontal frequency bands 704-707. In one embodiment of the present invention, four frequency bands are used:

frequency band 1: 32.3 Hz to 1076.6 Hz;

frequency band 2: 1076.6 Hz to 3229.8 Hz;

frequency band 3: 3229.8 Hz to 7536.2 Hz; and frequency band 4: 7536.2 Hz to 13995.8 Hz.

The strength-of-onset values in each of the cells within vertical columns of the frequency bands, such as vertical column 708 in frequency band 705, are summed to produce a strength-of-onset value D(t,b) for each time point t in each frequency band b, as described by expression 710 in FIG. 7A. The strength-of-onset values D(t, b) for each value of b are separately collected to produce a discrete strength-of-onset/time function, represented as a one-dimensional array of D(t) values, for each frequency band, a plot 716 for one of which is shown in FIG. 7B. The strength-of-onset/time functions for each of the frequency bands are then analyzed, in a process described below, to produce an estimated tempo for the audio signal.

Figure 8:
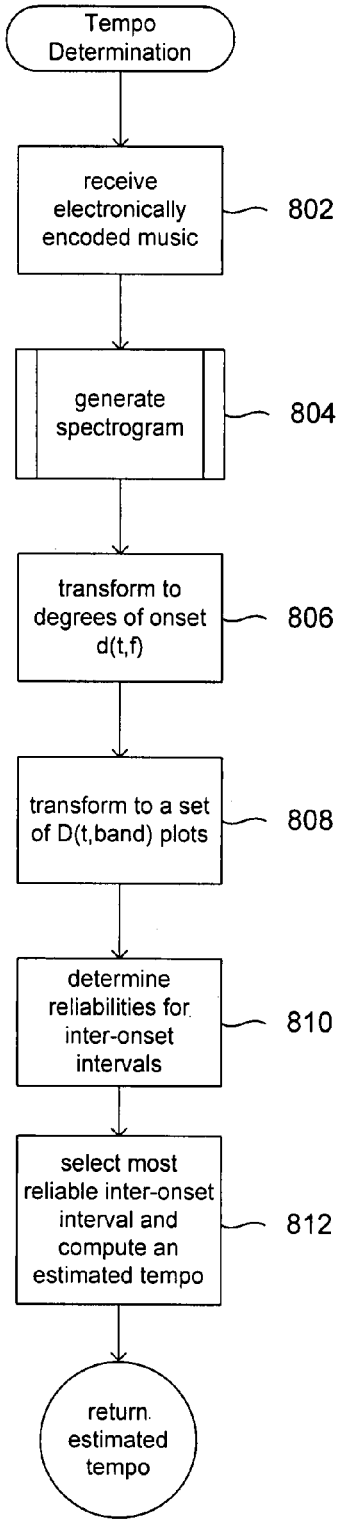
FIG. 8 is a flow-control diagram that illustrates one tempo-estimation method embodiment of the present invention.

FIG. 8 is a flow-control diagram that illustrates one tempo-estimation method embodiment of the present invention. In a first step 802, the method receives electronically encoded music, such as a .wav file. In step 804, the method generates a spectrogram for a short portion of the electronically encoded music. In step 806, the method transforms the spectrogram to a two-dimensional strength-of-onset matrix containing d(t,f) values, as discussed above with reference to FIGS. 6A-C. Then, in step 808, the method transforms the two-dimensional strength-of-onset matrix to a set of strength-of-onset/time functions for a corresponding set of frequency bands, as discussed above with reference to FIGS. 7A-B. In step 810, the method determines reliabilities for a range of inter-onset intervals within the set of strength-of-onset/time functions generated in step 808, by a process to be described below. Finally, in step 812, the process selects a most reliable inter-onset-interval, computes an estimated tempo based on the most reliable inter-onset interval, and returns the estimated tempo.

A process for determining reliabilities for a range of inter-onset intervals, represented by step 810 in FIG. 8, is described below as a C++-like pseudocode implementation. However, prior to discussing the C++-like pseudocode implementation of reliability determination and estimated-tempo computation, various concepts related to reliability determination are first described with reference to FIGS. 9-13, to facilitate subsequent discussion of the C++-like pseudocode implementation.

Figure 9A:
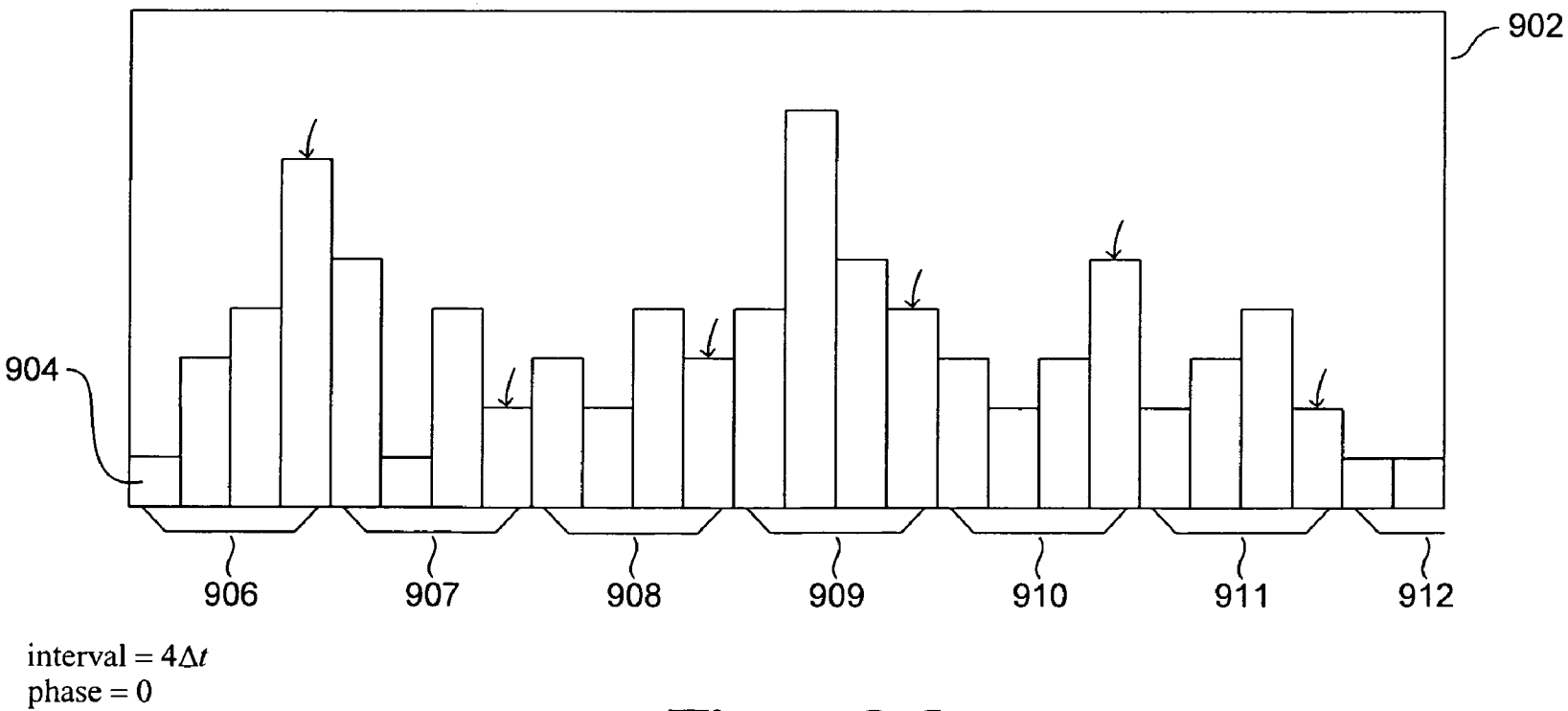
FIGS. 9A-D illustrate the concept of inter-onset intervals and phases.

FIGS. 9A-D illustrate the concept of inter-onset intervals and phases. In FIG. 9A, and in FIGS. 9B-D which follow, a portion of a strength-of-onset/time function for a particular frequency band 902 is displayed. Each column in the plot of the strength-of-onset/time function, such as the first column 904, represents a strength-of-onset value D(t,b) at a particular sample time for a particular band. A range of inter-onset-interval lengths is considered in the process for estimating a tempo. In FIG. 9A, short 4-column-wide inter-onset intervals 906-912 are considered. In FIG. 9A, each inter-onset interval includes four D(t,b) values over a time interval of 4Δt, where Δt is equal to the short time period corresponding to a sample point. Note that, in actual tempo estimation, inter-onset intervals are generally much longer, and a strength-of-onset/time function may contain tens of thousands or greater numbers of D(t,b) values. The illustrations use artificially small values for the sake of illustration clarity.

A D(t,b) value in each inter-onset interval ("IOI") at the same position in each IOI may be considered as a potential point of onset, or point with a rapid rise in intensity, that may indicate a beat or tempo point within the musical selection. A range of IOIs are evaluated in order to find an IOI with the greatest regularity or reliability in having high D(t,b) values at the selected D(t,b) position within each interval. In other words, when the reliability for a contiguous set of intervals of fixed length is high, the IOI typically represents a beat or frequency within the musical selection. The most reliable IOI determined by analyzing a set of strength-of-onset/time functions for a corresponding set of frequency bands is generally related to the estimated tempo. Thus, the reliability analysis of step 810 in FIG. 8 considers a range of IOI lengths from some minimum IOI length to a maximum IOI length and determines a reliability for each IOI length.

Figure 9B:
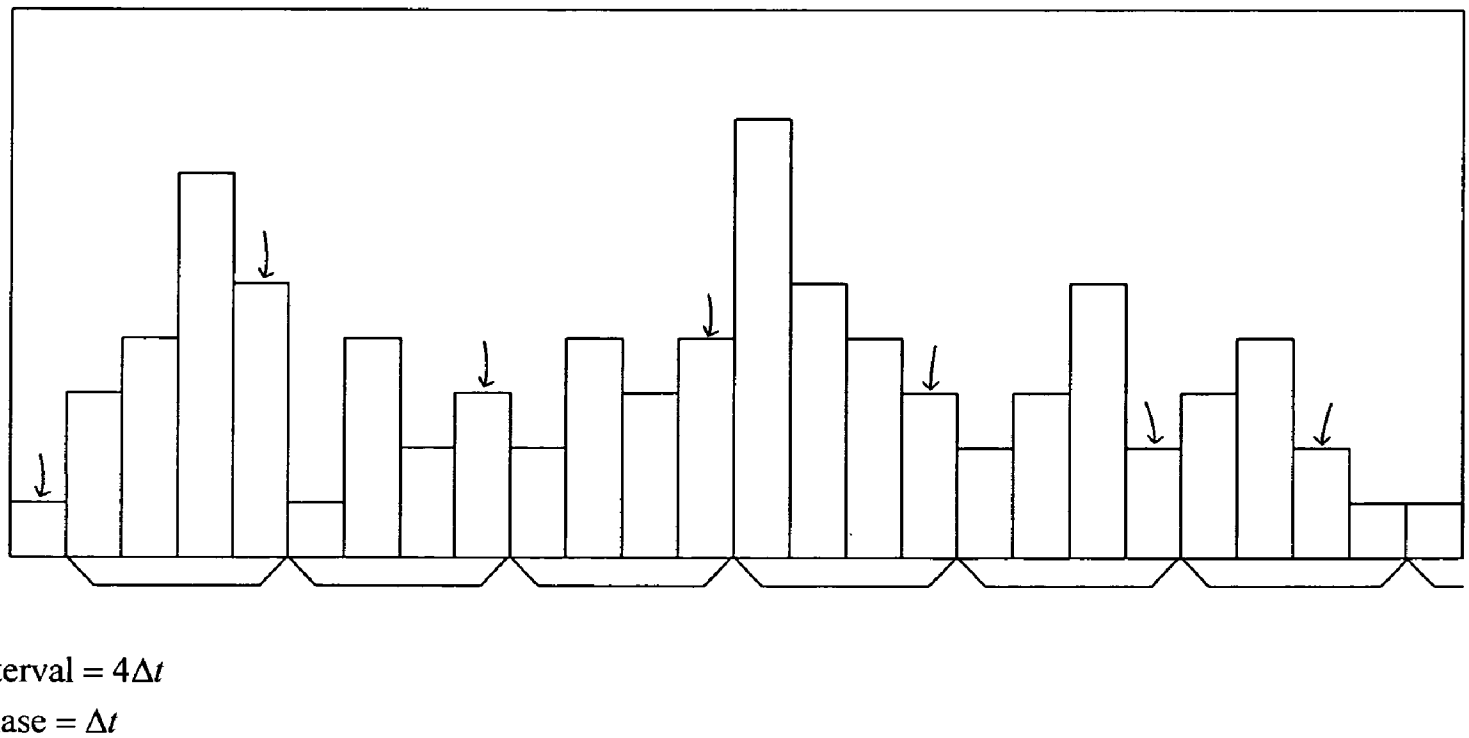
Figure 9C:
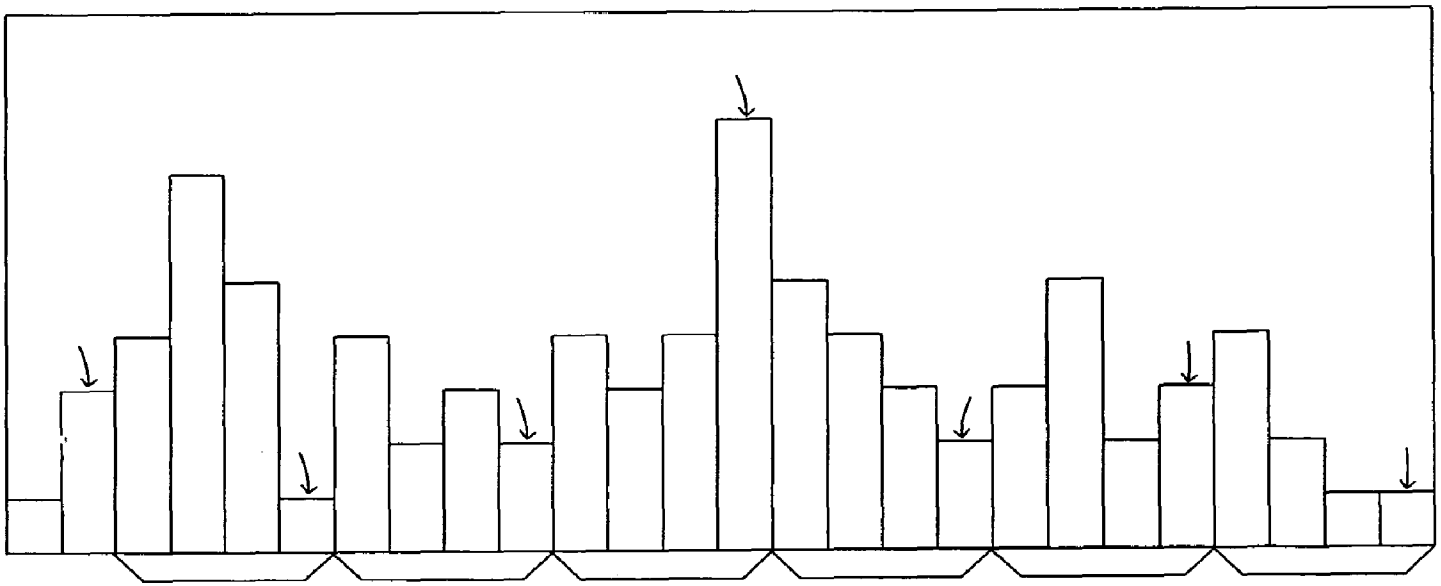
Figure 9D:
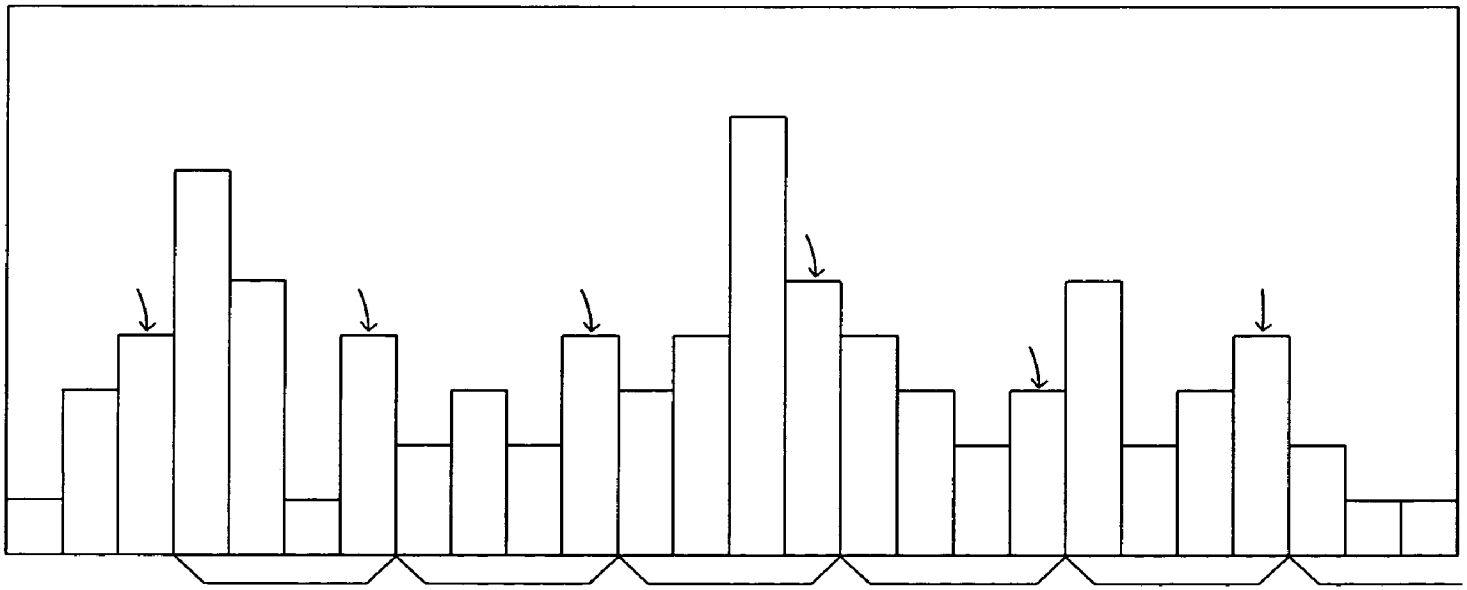
Figure 10:
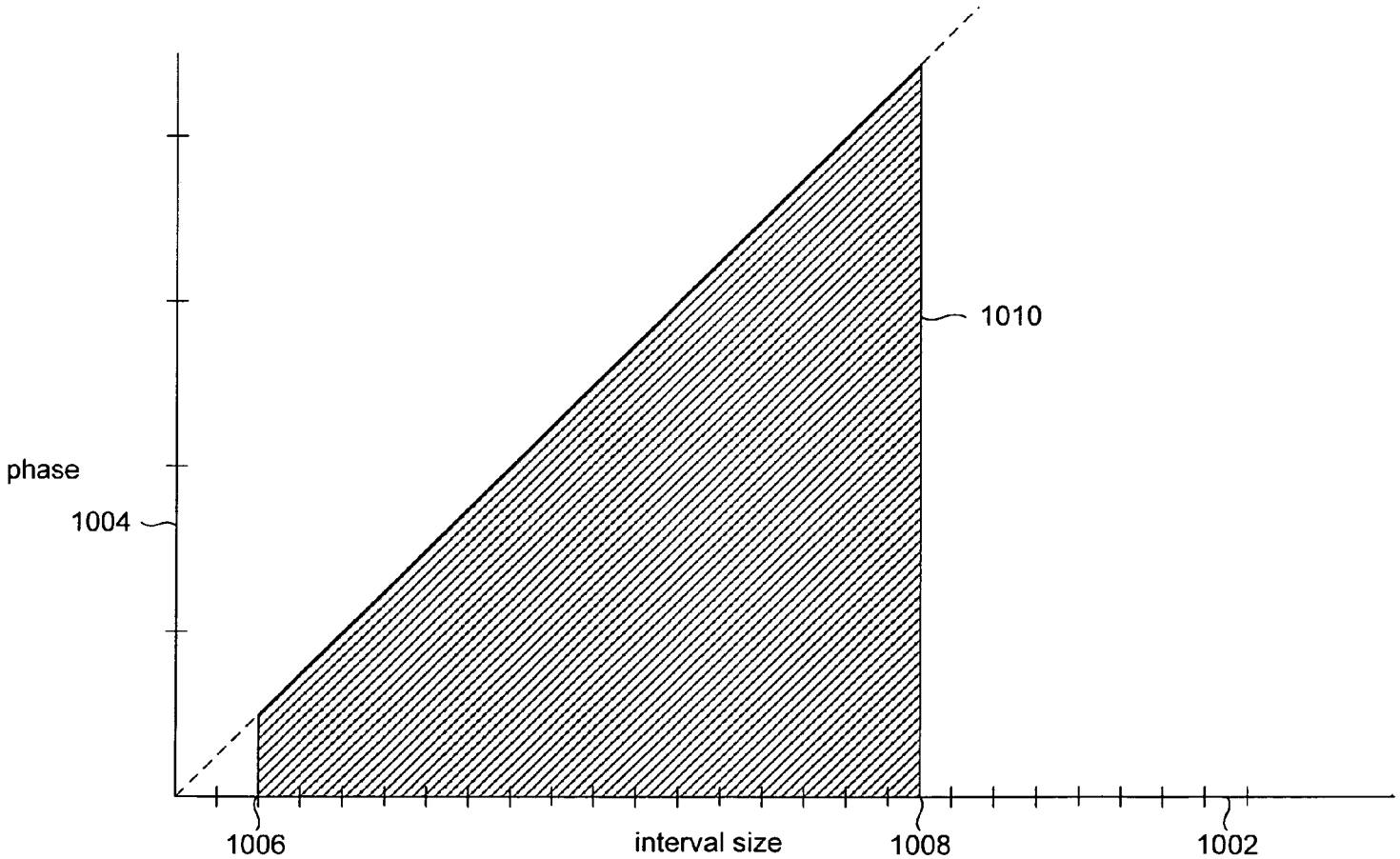
FIG. 10 illustrates the state space of the search represented by step 810 in FIG. 8.

For each selected IOI length, a number of phases equal to one less than the IOI length need to be considered in order to evaluate all possible onsets, or phases, of the selected D(t,b) value within each interval of the selected length with respect to the origin of the strength-of-onset/time function. If the first column 904 in FIG. 9A represents time $t_0$, then the intervals 906-912 shown in FIG. 9 can be considered to represent 4Δt intervals, or 4-column-wide IOIs with a phase of zero. In FIGS. 9B-D, the beginning of the intervals is offset by successive positions along the time axis to produce successive phases of Δt, 2Δt, and 3Δt, respectively. Thus, by evaluating all possible phases, or starting points relative to $t_0$, for a range of possible IOI lengths, one can exhaustively search for reliably occurring beats within the musical selection. FIG. 10 illustrates the state space of the search represented by step 810 in FIG. 8. In FIG. 10, IOI length is plotted along a horizontal axis 1002 and phase is plotted along a vertical axis 1004, both the IOI length and phase plotted in increments of Δt, the period of time represented by each sample point. As shown in FIG. 10, all interval sizes between a minimum interval size 1006 and a maximum interval size 1008 are considered, and for each IOI length, all phases between zero and one less than the IOI length are considered. Therefore, the state space of the search is represented by the shaded area 1010.

Figure 11:
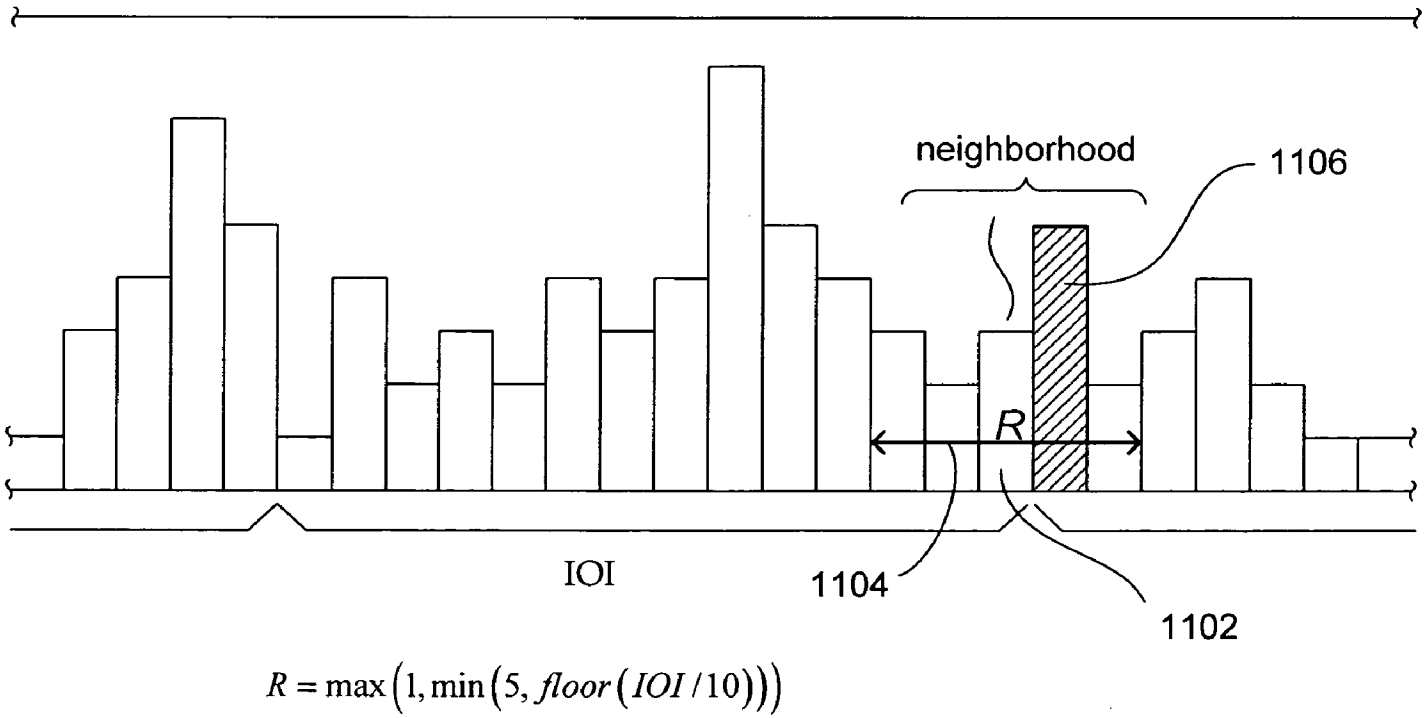
FIG. 11 illustrates selection of a peak D(t,b) value within a neighborhood of D(t,b) values according to embodiments of the present invention.

As discussed above, a particular D(t,b) value within each IOI, at a particular position within each IOI, is chosen for evaluating the reliability of the IOI. However, rather than selecting exactly the D(t,b) value at the particular position, D(t,b) values within a neighborhood of the position are considered, and the D(t,b) value in the neighborhood of the particular position, including the particular position, with maximum value is selected as the D(t,b) value for the IOI. FIG. 11 illustrates selection of a peak D(t,b) value within a neighborhood of D(t,b) values according to embodiments of the present invention. In FIG. 11, the final D(t,b) value in each IOI, such as D(t,b) value 1102, is the initial candidate D(t,b) value that represents an IOI. A neighborhood R 1104 about the candidate D(t,b) value is considered, and the maximum D(t,b) value within the neighborhood, in the case shown in FIG. 11 D(t,b) value 1106, is selected as the representative D(t,b) value for the IOI.

Figure 12:
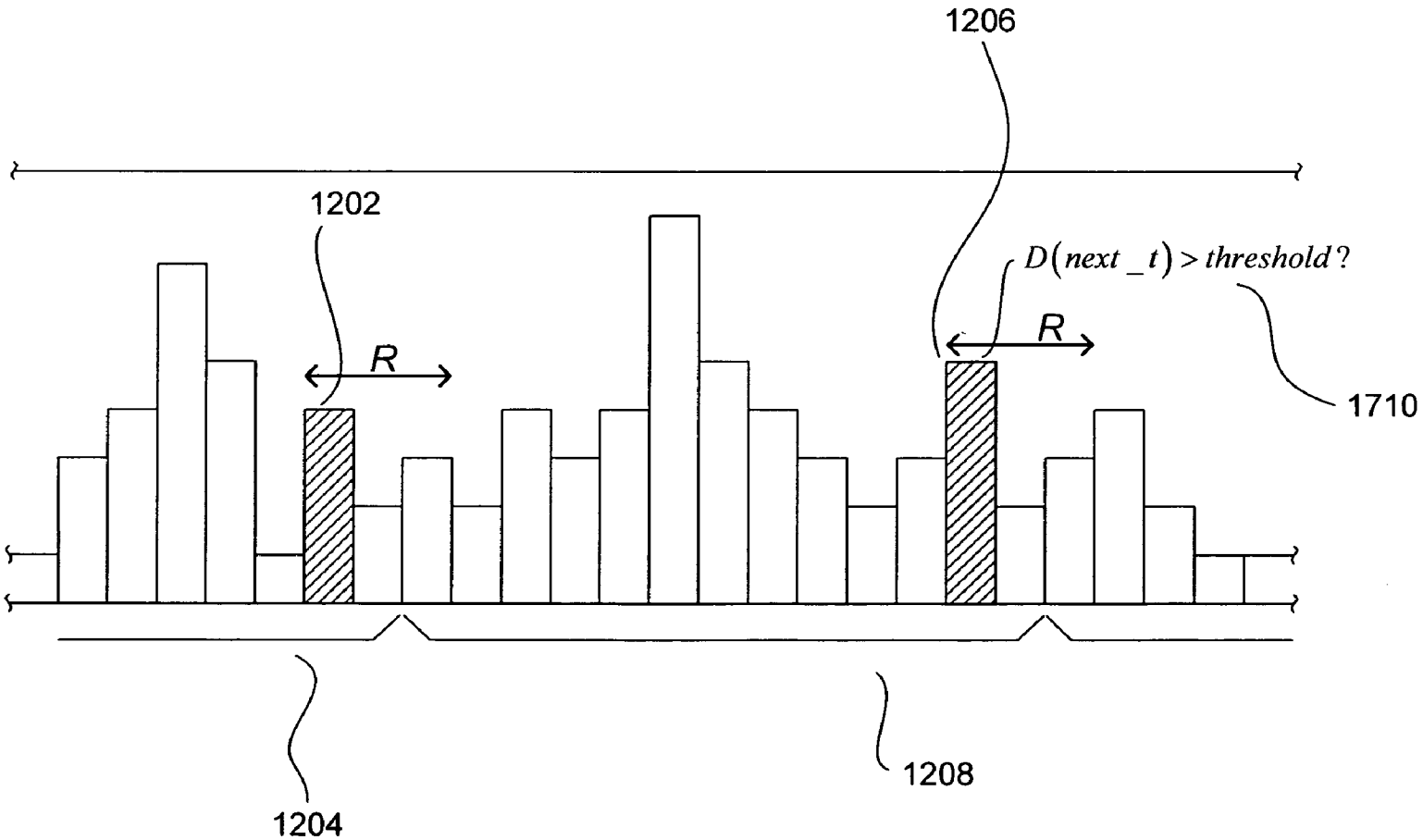
FIG. 12 illustrates one step in the process of computing reliability by successively considering representative D(t,b) values of inter-onset intervals along the time axis.

As discussed above, the reliability for a particular IOI length for a particular phase is computed as the regularity at which a high D(t,b) value occurs at the selective, representative D(t,b) value for each IOI in a strength-of-onset/time function. Reliability is computed by successively considering the representative D(t,b) values of IOIs along the time axis. FIG. 12 illustrates one step in the process of computing reliability by successively considering representative D(t,b) values of inter-onset intervals along the time axis. In FIG. 12, a particular, representative D(t,b) value 1202 for a IOI 1204 has been reached. The next representative D(t,b) value 1206 for the next IOI 1208 is found, and a determination is made as to whether the next representative D(t,b) value is greater than a threshold value, as indicated by expression 1210 in FIG. 12. If so, a reliability metric for the IOI length and phase is incremented to indicate that a relatively high D(t,b) value has been found in the next IOI relative to the currently considered IOI 1204.

Figure 13:
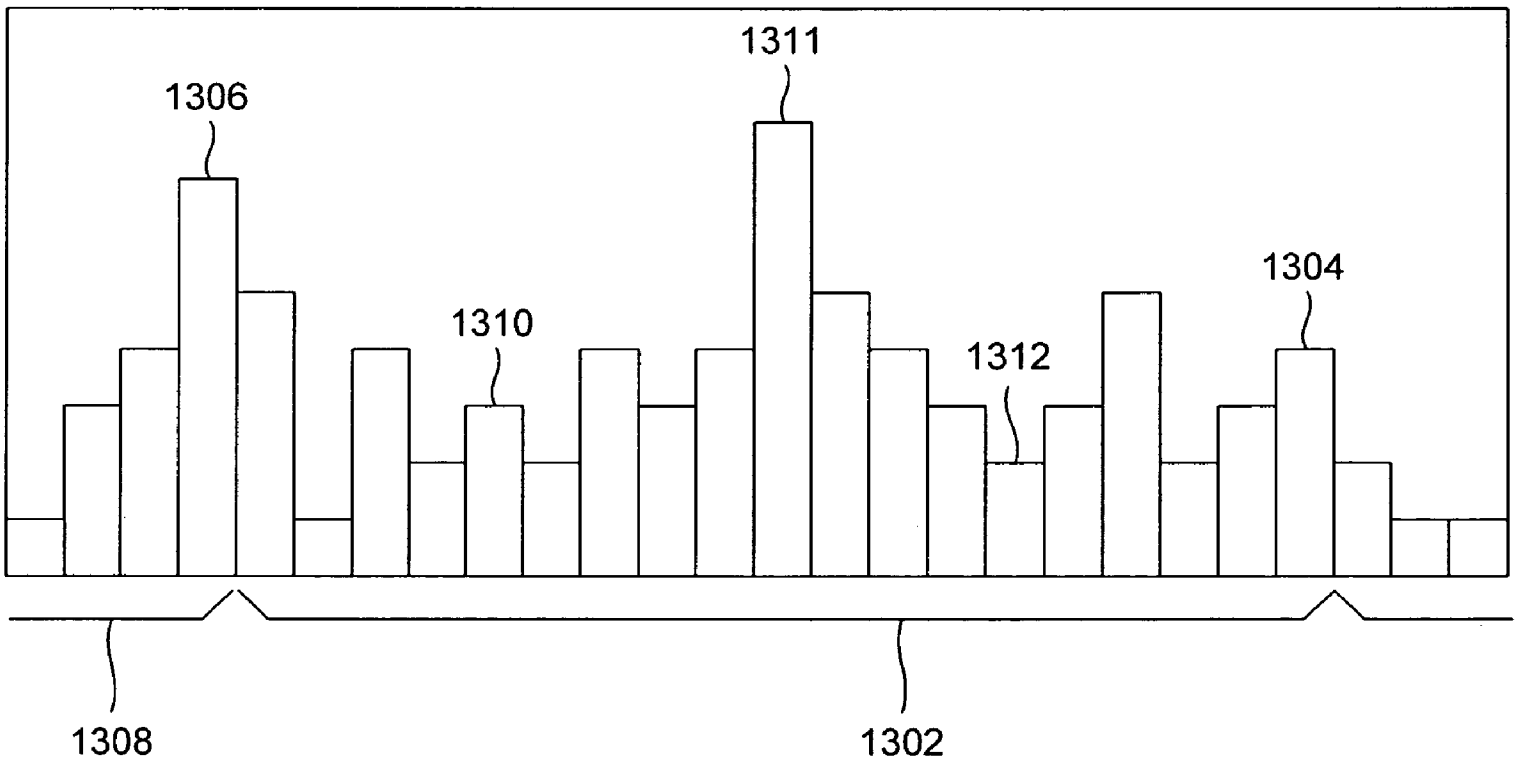
FIG. 13 illustrates the discounting, or penalizing, of an inter-onset intervals based on identification of a potential, higher-order frequency, or tempo, in the inter-onset interval.

While the reliability, as determined by the method discussed above with reference to FIG. 12, is one factor in determining an estimated tempo, reliabilities are discounted for particular IOIs when higher-order tempos are found within an IOI. FIG. 13 illustrates the discounting, or penalizing, of a currently considered inter-onset interval based on identification of a potential, higher-order frequency, or tempo, in the inter-onset interval. In FIG. 13, IOI 1302 is currently being considered. As discussed above, the magnitude of the D(t,b) value 1304 at the final position within the IOI is considered when determining the reliability with respect to the candidate D(t,b) value 1306 in the previous IOI 1308. However, if significant D(t,b) values are detected at higher-order harmonics of the frequency represented by the IOI, such as at D(t,b) values 1310-1312, then the currently considered IOI may be penalized. Detection of higher-order harmonic frequencies across a large number of the IOIs during evaluation of a particular IOI length indicates that there may be a faster, higher-order harmonic tempo in the musical selection that may better estimate the tempo. Thus, as will be discussed in great detail below, computed reliabilities are offset by penalties when higher-order harmonic frequencies are detected.

The following C++-like pseudocode implementation of steps 810 and 812 in FIG. 8 is provided to illustrate, in detail, one possible method embodiment of the present invention for estimating tempo from a set of strength-of-onset/time functions for a corresponding set of frequency bands derived from a two-dimensional strength-of-onset matrix. First, a number of constants are declared:

```
1 const int maxT;
2 const double tDelta ;
3 const double Fs;
4 const int maxBands = 4;
5 const int numFractionalOnsets = 4;
6 const double fractionalOnsets[numFractionalOnsets] =
  {0.666, 0.5, 0.333, .25};
```

-continued

```
7 const double fractionalCoefficients[numFractionalOnsets] =
  {0.4, 0.25, 0.4, 0.8};
8 const int Penalty = 0;
9 const double g[maxBands] = {1.0, 1.0, 0.5, 0.25};
```

These constants include: (1) maxT, declared above on line 1, which represents the maximum time sample, or time index along the time axis, for strength-of-onset/time functions; (2) tDelta, declared above on line 2, which contains a numerical value for the time period represented by each sample; (3) Fs, declared above on line 3, representing the samples collected per second; (4) maxBands, declared on line 4, representing the maximum number of frequency bands into which the initial two-dimensional strength-of-onset matrix can be partitioned; (5) numFractionalOnsets, declared above on line 5, which represents the number of positions corresponding to higher-order harmonic frequencies within each IOI that are evaluated in order to determine a penalty for the IOI during reliability determination; (6) fractionalOnsets, declared above on line 6, an array containing the fraction of an IOI at which each of the fractional onsets considered during penalty calculation is located within the IOI; (7) fractionalCoefficients, declared above on line 7, an array of coefficients by which D(t,b) values occurring at the considered fractional onsets within an IOI are multiplied during computation of the penalty for the IOI; (8) Penalty, declared above on line 8, a value subtracted from estimated reliability when the representative D(t,b) value for an IOI falls below a threshold value; and (9) g, declared above on line 9, an array of gain values by which reliabilities for each of the considered IOIs in each of the frequency bands are multiplied, in order to weight reliabilities for IOIs in certain frequency bands higher than corresponding reliabilities in other frequency bands.

Next, two classes are declared. First, the class "OnsetStrength" is declared below:

```
 1 class OnsetStrength
 2 {
 3   private:
 4     int D_t[maxT];
 5     int sz;
 6     int minF;
 7     int maxF;
 8
 9   public:
10     int operator [ ] (int i)
11       {if (i < 0 || i >= maxT) return −1; else return (D_t[i]);};
12     int getSize ( ) {return sz;};
13     int getMaxF ( ) {return maxF;};
14     int getMinF ( ) {return minF;};
15     OnsetStrength( );
16 };
```

The class "OnsetStrength" represents a strength-of-onset/time function corresponding to a frequency band, as discussed above with reference to FIGS. 7A-B. A full declaration for this class is not provided, since it is used only to extract D(t,b) values for computation of reliabilities. Private data members include: (1) D_t, declared above on line 4, an array containing D(t,b) values; (2) sz, declared above on line 5, the size of, or number of D(t,b) values in, the strength-of-onset/time function; (3) minF, declared above on line 6, the minimum frequency in the frequency band represented by an instance of the class "OnsetStrength"; and (4) maxF, the maximum frequency represented by an instance of the class "OnsetStrength." The class "OnsetStrength" includes four public function members: (1) the operator [ ], declared above on line 10, which extracts the D(t,b) value corresponding to a specified index, or sample number, so that the instance of the class OnsetStrength functions as a one-dimensional array; (2) three functions getSize, getMaxF, and getMinF that return current values of the private data members sz, minF, and maxF, respectively; and (3) a constructor.

Next, the class "TempoEstimator" is declared:

```
 1 class TempoEstimator
 2 {
 3   private:
 4     OnsetStrength* D;
 5     int numBands;
 6     int maxIOI;
 7     int minIOI;
 8     int thresholds[maxBands];
 9     int fractionalTs[numFractionalOnsets];
10     double reliabilities[maxBands][maxT];
11     double finalReliability[maxT];
12     double penalties[maxT];
13
14     int findPeak(OnsetStrength& dt, int t, int R);
15     void computeThresholds( );
16     void computeFractionalTs(int IOI);
17     void nxtReliabilityAndPenalty
18       (int IOI, int phase, int band, double & reliability,
19       double & penalty);
20
21   public:
22     void setD (OnsetStrength* d, int b) {D = d; numBands = b;};
23     void setMaxIOI(int mxIOI) {maxIOI = mxIOI;};
24     void setMinIOI(int mnIOI) {minIOI = mnIOI;};
25     int estimateTempo( );
26     TempoEstimator( );
27 };
```

The class "TempoEstimator" includes the following private data members: (1) D, declared above on line 4, an array of instances of the class "OnsetStrength" representing strength-of-onset/time functions for a set of frequency bands; (2) numBands, declared above on line 5, which stores the number of frequency bands and strength-of-onset/time functions currently being considered; (3) maxIOI and minIOI, declared above on lines 6-7, the maximum IOI length and minimum IOI length to be considered in reliability analysis, corresponding to points 1008 and 1006 in FIG. 10, respectively; (4) thresholds, declared on line 8, an array of computed thresholds against which representative D(t,b) values are compared during reliability analysis; (5) fractionalTs, declared on line 9, the offsets, in Δt, from the beginning of an IOI corresponding to the fractional onsets to be considered during computation of a penalty for the IOI based on the presence of higher-order frequencies within a currently considered IOI; (6) reliabilities, declared on line 10, a two-dimensional array storing the computed reliabilities for each IOI length in each frequency band; (7) finalReliability, declared on line 11, an array storing the final reliabilities computed by summing reliabilities determined for each IOI length in a range of IOIs for each of the frequency bands; and (8) penalties, declared on line 12, an array that stores penalties computed during reliability analysis. The class "TempoEstimator" includes the following private function members: (1) findPeak, declared on line 14, which identifies the time point of the maximum peak within a neighborhood R, as discussed above with reference to FIG. 11; (2) computeThresholds, declared on line 15, which computes threshold values stored in the private data member thresholds; (3) computeFractionalTs, declared on line 16, which computes the offsets, in time, from the beginning of IOIs of a particular length corresponding to higher-order harmonic frequencies considered for computing penalties; (4) nxtReliabilityAndPenalty, declared on line 17, which computes a next reliability and penalty value for a particular IOI length, phase, and band. The class "TempoEstimator" includes the following public function members: (1) setD, declared above on line 22, which allows a number of strength-of-onset/time functions to be loaded into an instance of the class "TempoEstimator"; (2) setMax and setMin, declared above on lines 23-24, that allow the maximum and minimum IOI lengths that define the range of IOIs considered in reliability analysis to be set; (3) estimateTempo, which estimates tempo based on the strength-of-onset/time functions stored in the private data member D; and (4) a constructor.

Next, implementations for various functions members of the class "TempoEstimator" are provided. First, an implementation of the function member "findpeak" is provided:

```
1  int TempoEstimator::findPeak(OnsetStrength& dt, int t, int R)
2  {
3      int max = 0;
4      int nextT;
5      int i;
6      int start = t − R/2;
7      int finish = t + R;
8
9      if (start < 0) start = 0;
10     if (finish > dt.getSize( )) finish = dt.getSize( );
11
12     for (i = start; i < finish; i++)
13     {
14       if (dt[i] > max)
15       {
16         max = dt[i];
17         nextT = i;
18       }
19     }
20     return nextT;
21 }
```

The function member "findpeak" receives a time value and neighborhood size as parameters t and R, as well as a reference to a strength-of-onset/time function dt in which to find the maximum peak within a neighborhood about time point t, as discussed above with reference to FIG. 11. The function member "findPeak" computes a start and finish time corresponding to the horizontal-axis points that bound the neighborhood, on lines 9-10, and then, in the for-loop of lines 12-19, examines each D(t,b) value within that neighborhood to determine a maximum D(t,b) value. The index, or time value, corresponding to the maximum D(t,b) is returned on line 20.

Next, an implementation of the function member "computeThresholds" is provided:

```
1  void TempoEstimator::computeThresholds( )
2  {
3    int i, j;
4    double sum;
5
6    for (i = 0; i < numBands; i++)
7    {
8      sum = 0.0;
9      for (j = 0; j < D[i].getSize( ); j++)
10     {
11       sum += D[i][j];
12     }
```

-continued

```
13       thresholds[i] = int(sum / j);
14   }
15 }
```

This function computes the average D(t,b) value for each strength-of-onset/time function, and stores the average D(t,b) value as the threshold for each strength-of-onset/time function.

Next, an implementation of the function member "nxtReliabilityAndPenalty" is provided:

```
1  void TempoEstimator::nxtReliabilityAndPenalty
2              (int IOI, int phase, int band, double & reliability,
3              double & penalty)
4  {
5    int i;
6    int valid = 0;
7    int peak = 0;
8    int t = phase;
9    int nextT;
10   int R = IOI/10;
11   double sqt;
12
13   if (!(R%2)) R++;
14   if (R > 5) R = 5;
15
16   reliability = 0;
17   penalty = 0;
18
19   while (t < (D[band].getSize( ) − IOI))
20   {
21     nextT = findPeak(D[band], t + IOI, R);
22     peak++;
23     if (D[band][nextT] > thresholds[band])
24     {
25       valid++;
26       reliability += D[band][nextT];
27     }
28     else reliability −= Penalty;
29
30     for (i = 0; i < numFractionalOnsets; i++)
31     {
32       penalty += D[band][findPeak
33           (D[band], t + fractionalTs[i],
34           R)] * fractionalCoefficients[i];
35     }
36
37     t += IOI;
38   }
39   sqt = sqrt(valid * peak);
40   reliability /= sqt;
41   penalty /= sqt;
42 }
```

The function member "nxtReliabilityAndPenalty" computes a reliability and penalty for a specified IOI size, or length, a specified phase, and a specified frequency band. In other words, this routine is called to compute each value in the two-dimensional private data member reliabilities. The local variables valid and peak, declared on lines 6-7, are used to accumulate counts of above-threshold IOIs and total IOIs as the strength-of-onset/time function is analyzed to compute a reliability and penalty for the specified IOI size, phase, specified frequency band. The local variable t, declared on line 8, is set to the specified phase. The local variable R, declared on line 10, is the length of the neighborhood from which to select a representative D(t,b) value, as discussed above with reference to FIG. 11.

In the while-loop of lines 19-38, successive groups of contiguous D(t,b) values of length IOI are considered. In other words, each iteration of the loop can be considered to analyze a next IOI along the time axis of a plotted strength-of-onset/time function. In line 21, the index of the representative D(t,b) value of the next IOI is computed. Local variable peak is incremented, on line 22, to indicate that another IOI has been considered. If the magnitude of the representative D(t,b) value for the next IOI is above the threshold value, as determined on line 23, then the local variable valid is incremented, on line 25, to indicate another valid representative D(t,b) value has been detected, and that D(t,b) value is added to the local variable reliability, on line 26. If the representative D(t,b) value for the next IOI is not greater than the threshold value, then the local variable reliability is decremented by the value Penalty. Then, in the for-loop of lines 30-35, a penalty is computed based on detection of higher-order beats within the currently considered IOI. The penalty is computed as a coefficient times the D(t,b) values of various inter-order harmonic peaks within the IOI, specified by the constant numFractionalOnsets and the array FractionalTs. Finally, on line 37, t is incremented by the specified IOI length, IOI, to index the next IOI to prepare for a subsequent iteration of the while-loop of lines 19-38. Both the cumulative reliability and penalty for the IOI length, phase, and band are normalized by the square root of the product of the contents of the local variables valid and peak, on lines 39-41. In alternative embodiments, nextT may be incremented by IOI, on line 37, and the next peak found by calling findPeak(D[band], nextT+IOI, R) on line 21.

Next, an implementation for the function member "computeFractionalTs" is provided:

```
1 void TempoEstimator::computeFractionalTs(int IOI)
2 {
3    int i;
4
5    for (i = 0; i < numFractionalOnsets; i++)
6    {
7       fractionalTs[i] = int(IOI * fractionalOnsets[i]);
8    }
9 }
```

This function member simply computes the offsets, in time, from the beginning of an IOI of specified length based on the fractional onsets stored in the constant array "fractional Onsets."

Finally, an implementation for the function member "EstimateTempo" is provided:

```
1  int TempoEstimator::estimateTempo( )
2  {
3     int band;
4     int IOI;
5     int IOI2;
6     int phase;
7     double reliability = 0.0;
8     double penalty = 0.0;
9     int estimate = 0;
10    double e;
11
12    if (D == 0) return −1;
13    for (IOI = minIOI; IOI < maxIOI; IOI++)
14    {
15       penalties[IOI] = 0.0;
16       finalReliability[IOI] = 0.0;
17       for (band = 0; band < numBands; band++)
18       {
19          reliabilities[band][IOI] = 0.0;
```

-continued

```
20       }
21    }
22    computeThresholds( );
23
24    for (band = 0; band < numBands; band++)
25    {
26       for (IOI = minIOI; IOI < maxIOI; IOI++)
27       {
28          computeFractionalTs(IOI);
29          for (phase = 0; phase < IOI − 1; phase++)
30          {
31             nxtReliabilityAndPenalty
32                (IOI, phase, band, reliability, penalty);
33             if (reliabilities[band][IOI] < reliability)
34             {
35                reliabilities[band][IOI] = reliability;
36                penalties[IOI] = penalty;
37             }
38          }
39          reliabilities[band][IOI] −= 0.5 * penalties[IOI];
40       }
41    }
42
43    for (IOI = minIOI; IOI < maxIOI; IOI++)
44    {
45       reliability = 0.0;
46       for (band = 0; band < numBands; band++)
47       {
48          IOI2 = IOI / 2;
49          if (IOI2 >= minIOI)
50             reliability +=
51                g[band] * (reliabilities[band][IOI] +
52                   reliabilities[band][IOI/2]);
53          else reliability += g[band] * reliabilities[band][IOI];
54       }
55       finalReliability[IOI] = reliability;
56    }
57
58    reliability = 0.0;
59    for (IOI = minIOI; IOI < maxIOI; IOI++)
60    {
61       if (finalReliability[IOI] > reliability)
62       {
63          estimate = IOI;
64          reliability = finalReliability[IOI];
65       }
66    }
67
68    e = Fs / (tDelta * estimate);
69    e *= 60;
70    estimate = int(e);
71    return estimate;
72 }
```

The function member "estimateTempo" includes local variables: (1) band, declared on line 3, an iteration variable specifying the current frequency band or strength-of-onset/time function to be considered; (2) IOI, declared on line 4, the currently considered IOI length; (3) IOI2, declared on line 5, one-half of the currently considered IOI length; (4) phase, declared on line 6, the currently considered phase for the currently considered IOI length; (5) reliability, declared on line 7, the reliability computed for a currently considered band, IOI length, and phase; (6) penalty, the penalty computed for the currently considered band, IOI length, and phase; (7) estimate and e, declared on lines 9-10, used to compute a final tempo estimate.

First, on line 12, a check is made to see if a set of strength-of-onset/time functions has been input to the current instance of the class "TempoEstimator." Second, on lines 13-21, the various local and private data members used in tempo estimation are initialized. Then, on line 22, thresholds are computed for reliability analysis. In the for-loop of lines 24-41, a reliability and penalty is computed for each phase of each considered IOI length for each frequency band. The greatest reliability, and corresponding penalty, computed over all phases for a currently considered IOI length and a currently considered frequency band is determined and stored, on line 39, as the reliability found for the currently considered IOI length and frequency band. Next, in the for-loop of lines 43-56, final reliabilities are computed for each IOI length by summing the reliabilities for the IOI length across the frequency bands, each term multiplied by a gain factor stored in the constant array "g" in order to weight certain frequency bands greater than other frequency bands. When a reliability corresponding to an IOI of half the length of the currently considered IOI is available, the reliability for the half-length IOI is summed with the reliability for the currently considered IOI in this calculation, because it has been empirically found that an estimate of reliability for a particular IOI may depend on an estimate of reliability for an IOI of half the length of the particular IOI length. The computed reliabilities for time points are stored in the data member finalReliability, on line 55. Finally, in the for-loop of lines 59-66, the greatest overall computed reliability for any IOI length is found by searching the data member finalReliability. The greatest overall computed reliability for any IOI length is used, on lines 68-71, to compute an estimated tempo in beats per minute, which is returned on line 71.

Although the present invention has been described in terms of particular embodiments, it is not intended that the invention be limited to these embodiments. Modifications within the spirit of the invention will be apparent to those skilled in the art. For example, an essentially limitless number of alternative embodiments of the present invention can be devised by using different modular organizations, data structures, programming languages, control structures, and by varying other programming and software-engineering parameters. A wide variety of different empirical values and techniques used in the above-described implementation can be varied in order to achieve optimal tempo estimation under a variety of different circumstances for different types of musical selections. For example, various different fractional onset coefficients and numbers of fractional onsets may be considered for determining penalties based on the presence of higher-order harmonic frequencies. Spectrograms produced by any of a very large number of techniques using different parameters that characterize the techniques may be employed. The exact values by which reliabilities are incremented, decremented, and penalties are computed during analysis may be varied. The length of the portion of a musical selection sampled to produce the spectrogram may vary. Onset strengths may be computed by alternative methods, and any number of frequency bands can be used as the basis for computing the number of strength-of-onset/time functions.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Obviously many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

The invention claimed is:

1. A method for computationally estimating the tempo of a musical selection, the method comprising:

choosing a portion of the musical selection;

computing a spectrogram for the chosen portion of the musical selection;

transforming the spectrogram into a set of strength-of-onset/time functions for a corresponding set of frequency bands;

analyzing the set of strength-of-onset/time functions to determine a most reliable inter-onset-interval length by analyzing possible phases of each inter-onset-interval length in a range of inter-onset-interval lengths, including analysis of higher frequency harmonics corresponding to each inter-onset-interval length; and computing a tempo estimation from the most reliable inter-onset-interval length.

2. The method of claim 1 wherein choosing a portion of the musical selection further includes choosing a portion of the musical selection of a length, in time, of between 3 and 20 seconds.

3. The method of claim 1 wherein transforming the spectrogram into a set of strength-of-onset/time functions for a corresponding set of frequency bands further comprises:

transforming the spectrogram into a two-dimensional strength-of-onset matrix;

selecting a set of frequency bands; and for each frequency band, computing a strength-of-onset/time function.

4. The method of claim 3 wherein transforming the spectrogram into a two-dimensional strength-of-onset matrix further comprises:

for each interior-point value p(t,f) indexed by sample time t and frequency f in the spectrogram, computing a strength-of-onset value d(t,f) for sample time t and frequency f; and including the computed strength-of-onset value d(t,f) in the two-dimensional strength-of-onset-matrix cell with indices t and f.

5. The method of claim 4 wherein the strength-of-onset value d(t,f) computed for corresponding spectrogram interior-point value p(t,f) as:

$$d(t,f)=\max(p(t,f),np(t,f))-pp(t,f)$$

where np(t,f)=p(t=1,f);and $$pp(t,f)=\max\,(p(t-2,f),p(t-1,f+1),p(t-1,f),p(t-1,f-1)).$$

6. The method of claim 3 wherein selecting a set of frequency bands further includes:

partitioning a range of frequencies included in the spectrogram into a number of frequency bands.

7. The method of claim 6 wherein the spectrogram includes frequencies ranging from 32.3 Hz to 13995.8 Hz that are partitioned into the four frequency bands:

32.3 Hz to 1076.6 Hz;

1076.6 Hz to 3229.8 Hz;

3229.8 Hz to 7536.2 Hz; and 7536.2 Hz to 13995.8 Hz.

8. The method of claim 3 wherein computing a strength-of-onset/time function for a frequency band b further includes:

for each sample time $t_i$, computing a strength-of-onset value $D(t_i,b)$ by summing the strength-of-onset value d(t,f) in the two-dimensional strength-of-onset matrix for which t=t, and f is in the range of frequencies associated with frequency band b.

9. The method of claim 1 wherein analyzing the set of strength-of-onset/time functions to determine a most reliable inter-onset-interval length by analyzing possible phases of each inter-onset-interval length in a range of inter-onset-interval lengths, including analysis of higher frequency harmonics of each inter-onset-interval length, further comprises:

for each strength-of-onset/time function corresponding to a frequency band b, computing a reliability for each possible phase for each inter-onset length within the range of inter-onset-interval lengths;

summing the reliabilities, computed for each inter-onset-interval length, over the frequency bands to produce final, computed reliabilities for each inter-onset-interval length; and selecting a final, most reliable inter-onset-interval length as the inter-onset-interval length having the greatest final, computed reliability.

10. The method of claim 9 wherein computing a reliability for an inter-onset length with a particular phase further comprises:

initializing a reliability variable and penalty variable for the inter-onset length;

starting with a sample time displaced from the origin of a strength-of-onset/time function by the phase, and continuing until all inter-onset-interval-lengths of sample points within the strength-of-onset/time function have been considered selecting a next, currently considered inter-onset-interval-length of sample points, selecting a representative D(t,b) value from the strength-of-onset/time function for the selected next inter-onset-interval-length of sample points, when the selected a representative D(t,b) value is greater than a threshold value, incrementing the reliability variable by a value, when a potential higher-order beat frequency is detected within the currently considered inter-onset-interval-length of sample points; incrementing the penalty variable by a value, and when the selected a representative D(t,b) value is greater than a threshold value; and computing a reliability for the inter-onset length from the values in the reliability variable and the penalty variable.

11. The method of claim 10 wherein the a representative D(t,b) value for a currently considered next inter-onset-interval-length of sample points is selected from within a neighborhood about a fixed, fractional-time position within the inter-onset-interval-length of sample points.

12. The method of claim 1 wherein computing a tempo estimation from the most reliable inter-onset-interval length further comprises computing a tempo, in beats per minute, from the most reliable inter-onset-interval length, in units of sample points, using a fixed number of sample points collected per fixed time period to produce the spectrogram and using a time interval represented by each sample point.

13. Computer instructions stored in a computer-readable medium that implement the method of claim 1 for computationally estimating the tempo of a musical selection by:

choosing a portion of the musical selection;

computing a spectrogram for the chosen portion of the musical selection;

transforming the spectrogram into a set of strength-of-onset/time functions for a corresponding set of frequency bands;

analyzing the set of strength-of-onset/time functions to determine a most reliable inter-onset-interval length by analyzing possible phases of each inter-onset-interval length in a range of inter-onset-interval lengths, including analysis of higher frequency harmonics corresponding to each inter-onset-interval length; and computing a tempo estimation from the most reliable inter-onset-interval length.

14. A tempo estimation system comprising:

a computer system that can receive a digitally encoded audio signal; and a software program that estimates a tempo for the digitally encoded audio signal by:

choosing a portion of the musical selection;

computing a spectrogram for the chosen portion of the musical selection;

transforming the spectrogram into a set of strength-of-onset/time functions for a corresponding set of frequency bands;

analyzing the set of strength-of-onset/time functions to determine a most reliable inter-onset-interval length by analyzing possible phases of each inter-onset-interval length in a range of inter-onset-interval lengths, including analysis of higher frequency harmonics corresponding to each inter-onset-interval length; and computing a tempo estimation from the most reliable inter-onset-interval length.

15. The tempo estimation system of claim 14 wherein transforming the spectrogram into a set of strength-of-onset/time functions for a corresponding set of frequency bands further comprises:

transforming the spectrogram into a two-dimensional strength-of-onset matrix;

selecting a set of frequency bands; and for each frequency band, computing a strength-of-onset/time function.

16. The tempo estimation system of claim 15 wherein transforming the spectrogram into a two-dimensional strength-of-onset matrix further comprises:

for each interior-point value p(t,f) indexed by sample time t and frequency f in the spectrogram, computing a strength-of-onset value d(t,f) for sample time t and frequency f; and including the computed strength-of-onset value d(t,f) in the two-dimensional strength-of-onset-matrix cell with indices t and f.

17. The tempo estimation system of claim 16 wherein the strength-of-onset value d(t,f) computed for corresponding spectrogram interior-point value p(t,f) as:

$$d(t,f)=\max(p(t,f),np(t,f))-pp(t,f)$$

where $np(t,f)=p(t+1,f)$; and $$pp(t,f)=\max(p(t-2,f),p(t-1,f+1),p(t-1,f),p(t-1,f-1)).$$

18. The tempo estimation system of claim 15 wherein computing a strength-of-onset/time function for a frequency band b further includes:

for each sample time $t_i$, computing a strength-of-onset value $D(t_i, b)$ by summing the strength-of-onset value d(t,f) in the two-dimensional strength-of-onset matrix for which t=t, and f is in the range of frequencies associated with frequency band b.

19. The tempo estimation system of claim 14 wherein analyzing the set of strength-of-onset/time functions to determine a most reliable inter-onset-interval length by analyzing possible phases of each inter-onset-interval length in a range of inter-onset-interval lengths, including analysis of higher frequency harmonics of each inter-onset-interval length, further comprises:

for each strength-of-onset/time function corresponding to a frequency band b, computing a reliability each possible phase for each inter-onset length within the range of inter-onset-interval lengths;

summing the reliabilities, computed for each inter-onset-interval length, over the frequency bands to produce final, computed reliabilities for each inter-onset-interval length; and selecting a final, most reliable inter-onset-interval length as the inter-onset-interval length having the greatest final, computed reliability.

20. The tempo estimation system of claim 19 wherein computing a reliability for an inter-onset length with a particular phase further comprises:

initializing a reliability variable and penalty variable for the inter-onset length;

starting with a sample time displaced from the origin of a strength-of-onset/time function by the phase, and continuing until all inter-onset-interval-lengths of sample points within the strength-of-onset/time function have been considered selecting a next, currently considered inter-onset-interval-length of sample points, selecting a representative D(t,b) value from the strength-of-onset/time function for the selected next inter-onset-interval-length of sample points, when the selected a representative D(t,b) value is greater than a threshold value, incrementing the reliability variable by a value, when a potential higher-order beat frequency is detected within the currently considered inter-onset-interval-length of sample points; incrementing the penalty variable by a value, and when the selected a representative D(t,b) value is greater than a threshold value; and computing a reliability for the inter-onset length from the values in the reliability variable and the penalty variable.

* * * * *

UNITED STATES PATENT AND TRADEMARK OFFICE

CERTIFICATE OF CORRECTION

PATENT NO. : 7,645,929 B2
APPLICATION NO. : 11/519545
DATED : January 12, 2010
INVENTOR(S) : Yu-Yao Chang et al.

It is certified that error appears in the above-identified patent and that said Letters Patent is hereby corrected as shown below:

In column 16, line 48, in Claim 5, delete "np(t,f)=p(t=1,f)" and insert -- np(t,f)=p(t+1,f) --, therefor.

In column 18, line 62, in Claim 18, delete "t=t," and insert -- $t=t_i$ --, therefor.

Signed and Sealed this

Fifteenth Day of June, 2010

David J. Kappos

David J. Kappos
*Director of the United States Patent and Trademark Office*